US010391359B2

(12) United States Patent
McGrane et al.

(10) Patent No.: US 10,391,359 B2
(45) Date of Patent: Aug. 27, 2019

(54) TRAMPOLINE WIRING LOOM AND MAT SENSOR ATTACHMENT SYSTEM

(71) Applicant: TGOMA NZ LIMITED, Christchurch (NZ)

(72) Inventors: Rhiannon Emrys McGrane, Christchurch (NZ); John Robert Howe, Christchurch (NZ); Neil Adrian Trimboy, Rangiora (NZ); Nigel James Sharplin, North Canterbury (NZ); Steven Paul Morrison, Christchurch (NZ); Logan Alexander Stephens, Christchurch (NZ)

(73) Assignee: TGOMA NZ LIMITED, Christchurch (NZ)

( * ) Notice: Subject to any disclaimer, the term of this patent is extended or adjusted under 35 U.S.C. 154(b) by 0 days.

(21) Appl. No.: 15/535,939

(22) PCT Filed: Dec. 21, 2015

(86) PCT No.: PCT/IB2015/059813

§ 371 (c)(1),
(2) Date: Jun. 14, 2017

(87) PCT Pub. No.: WO2016/098084

PCT Pub. Date: Jun. 23, 2016

(65) Prior Publication Data

US 2017/0361155 A1 Dec. 21, 2017

Related U.S. Application Data

(60) Provisional application No. 62/094,157, filed on Dec. 19, 2014.

(51) Int. Cl.
*A63B 5/11* (2006.01)
*A63B 24/00* (2006.01)
*A63B 71/06* (2006.01)

(52) U.S. Cl.
CPC ..... *A63B 24/0003* (2013.01); *A63B 5/11* (2013.01); *A63B 24/00* (2013.01);
(Continued)

(58) Field of Classification Search
CPC ... A63B 5/11; A63B 24/0003; A63B 71/0619; A63B 24/0087; A63B 24/00; A63B 2220/803
See application file for complete search history.

(56) References Cited

U.S. PATENT DOCUMENTS 4,336,933 A * 6/1982 Appelbaum ..... A63B 69/0035 482/29
6,053,845 A * 4/2000 Publicover ..... A63B 5/11 482/27

(Continued)

FOREIGN PATENT DOCUMENTS

CA 2772801 A1 9/2012
WO 2016000928 A1 1/2016

*Primary Examiner* — Sundhara M Ganesan
(74) *Attorney, Agent, or Firm* — Dann, Dorfman, Herrell and Skillman

(57) ABSTRACT

A trampoline comprises multiple movement sensors associated with one or more parts of the trampoline which move when the trampoline is bounced on by a user such as the trampoline mat, and an electrical wiring loom which connects to the movement sensors to a controller or a common connector at another end of the wiring loom. Various sensor mount and wiring loom options are described.

13 Claims, 32 Drawing Sheets

(52) U.S. Cl.
CPC ..... *A63B 24/0087* (2013.01); *A63B 71/0619* (2013.01); *A63B 2220/803* (2013.01)

(56) References Cited

U.S. PATENT DOCUMENTS

| | | | | |
|---|---|---|---|---|
| 9,530,325 | B2 | 12/2016 | Hall | |
| 9,700,748 | B2 | 7/2017 | Howe | |
| 2005/0209053 | A1 | 9/2005 | Knox | |
| 2006/0135321 | A1* | 6/2006 | Chen ..... | A63B 5/11 482/27 |
| 2008/0102424 | A1 | 5/2008 | Holljes | |
| 2010/0190608 | A1 | 7/2010 | Publicover et al. | |
| 2011/0034300 | A1 | 2/2011 | Hall | |
| 2014/0038678 | A1 | 2/2014 | Chen | |
| 2015/0080186 | A1 | 3/2015 | Carlin et al. | |
| 2015/0335930 | A1 | 11/2015 | Dallmann | |
| 2017/0128779 | A1 | 5/2017 | Howe et al. | |

* cited by examiner

FIGURE 9a
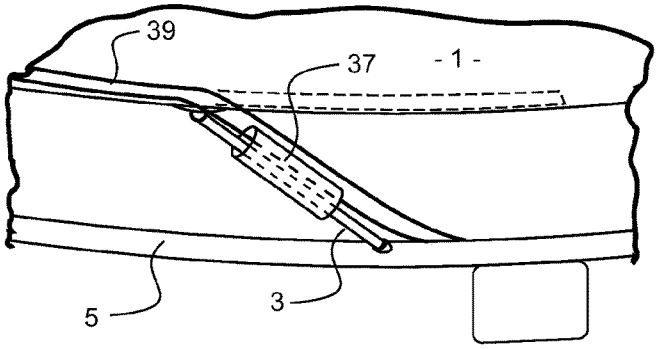
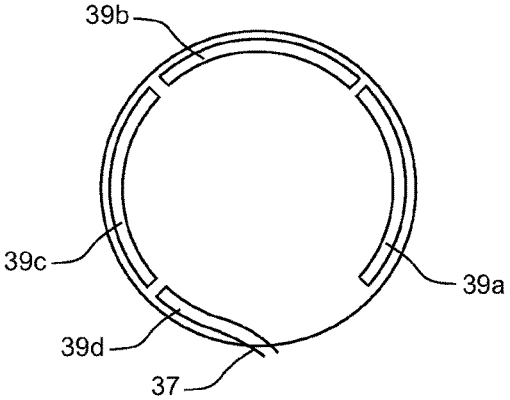
FIGURE 9b
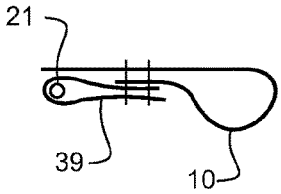
FIGURE 9c
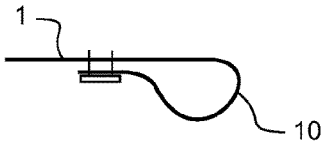
FIGURE 9d
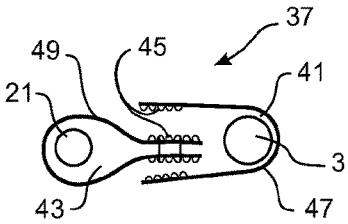
FIGURE 9e
FIGURE 9f
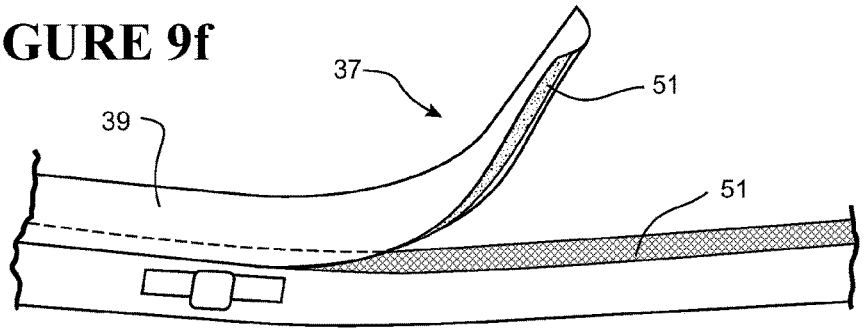

TRAMPOLINE WIRING LOOM AND MAT SENSOR ATTACHMENT SYSTEM

FIELD OF THE INVENTION

This invention relates to apparatus for measuring activity on a flexible mat of a trampoline.

BACKGROUND

Canadian patent publication CA 2,772,801 to Yjip Inc describes a trampoline including a frame and a jumping mat assembly that is supported by the frame to allow at least one user to bounce on the jumping mat. The trampoline also includes a sensor system that includes a plurality of sensors supported by the frame and/or the jumping mat assembly. The sensors are used to determine the status of a user or users on the trampoline.

The sensors are typically spaced apart from each other. A single bouncing load of the user triggers multiple sensors simultaneously. The multiple sensors can output different signals depending on the spatial relationship between the bouncing load and the particular sensor. The signals from the multiple sensors are compared to provide a location of the user on the trampoline.

Our international patent publication WO2014/098628 international patent application PCT/IB2015/055015 describe methods for measuring or interpreting an activity of a person or an object on a trampoline, which may utilise movement sensors attached to the trampoline mat.

The systems enhance trampoline gaming, and/or the use of trampolines for exercise, rehabilitation and the like.

SUMMARY OF THE INVENTION

In broad terms in a first aspect the invention comprises a trampoline comprising multiple movement sensors associated with one or more parts of the trampoline which move when the trampoline is bounced on by a user, which provide an electrical signal indicative of bouncing on the trampoline, or one or more sensor connectors for connecting to one or more said movement sensors, and an electrical wiring loom which connects to the movement sensors at one or more sensor ends of the wiring loom and extends from the movement sensors to a controller or a connector at another end of the wiring loom.

In at least some embodiments the wiring loom extends from said multiple movement sensors or movement sensor connectors to a common connector at said another end of the wiring loom.

In some embodiments the wiring loom comprises a first wiring loom branch to one or more movement sensors or sensor connectors and a second wiring loom branch to a one or more other movement sensors or sensor connectors. In some embodiments the wiring loom comprises a first wiring loom branch to two or more movement sensors or sensor connectors and a second wiring loom branch to two or more other movement sensors or sensor connectors. In some embodiments the first wiring loom branch is routed at or near one peripheral part of the mat and the second wiring loom branch is routed at or near another peripheral part of the mat.

In some embodiments the wiring loom comprises four or more wiring loom branches routed at or near a periphery of the mat to four movement sensors or sensor connectors.

In some embodiments the wiring loom comprises a single wiring loom branch routed at or near one a periphery of the mat to said multiple movement sensors or movement sensor connectors.

In at least some embodiments said multiple movement sensors or sensor connectors are associated with a mat of the trampoline. Alternatively the movement sensors or sensor connectors may be associated with a spring element of the trampoline In at least some embodiments at least a part of the wiring loom is routed at least in part in a pocket at or near a periphery of the mat.

In at least some embodiments at least a part of the wiring loom is routed from at or near a periphery of the mat along a spring element of the trampoline to or towards a frame of the trampoline.

In at least some embodiments said multiple movement sensors are associated with a mat of the trampoline and are attached to the trampoline mat each by a mount comprising a topside mount part and an underside mount part which are fixed together through the trampoline mat. In at least some embodiments said topside part and underside part are fixed together through the trampoline mat by at least one projection from one of said topside part and underside parts which is snap fit received in the other of said topside part and underside parts.

In at least some embodiments the wiring loom extends at said another end of the wiring loom to a controller and/or battery enclosure attached to a frame of the trampoline.

In at least some embodiments the trampoline also comprises a display mount for mounting to the trampoline a display driven by the controller. In some embodiments the display mount is adapted to mount the display to an enclosure above and around the mat of the trampoline.

In broad terms in a second aspect the invention comprises trampoline electrical wiring loom system comprising:

- a wiring loom
- multiple movement sensors attached an electrically connected to the wiring loom, to provide an electrical signal indicative of bouncing on the trampoline when attached to a part or parts of the trampoline which move when the trampoline is bounced on by a user, and
- a controller or a connector at an end of the wiring loom.

In at least some embodiments the multiple movement sensors are each attached to the wiring loom by a plastics material encapsulation of said sensor.

In at least some embodiments the trampoline electrical wiring loom system includes mounts for attaching the multiple movement sensors to a mat of the trampoline, each mount comprising a topside mount part and an underside mount part adapted to be fixed together through the trampoline mat to mount the movement sensor to the trampoline mat.

In at least some embodiments the trampoline electrical wiring loom system includes a trampoline mat comprising multiple movement sensors or multiple movement sensor mounts attached at spaced locations to the mat.

As stated the assembly may comprise multiple wiring loom branches. Each of the wiring loom branches may be the same length as the other wiring loom branches or different lengths. The loom assembly may have one sensor for each wiring loom branch. Alternatively, the loom assembly may have two or more sensors for each wiring loom branch. In one embodiment, the loom assembly further comprises at least one bus.

In one embodiment, the assembly comprises a first wiring loom branch comprising a first pair of sensors and a second wiring loom branch comprising a second pair of sensors. In this embodiment, the first wiring loom is the same length as the second wiring loom. The assembly may comprise a cable guide having a controlled bend radius. In this embodiment, the two wiring loom branches are connected to the controller.

In one embodiment, the assembly comprises one wiring loom branch for each sensor. In this embodiment, each wiring loom branch is a different length to the other wiring loom branches. In particular, the assembly comprises four sensors and four wiring loom branches having different lengths. The four wiring loom branches are preferably connected to a coupler, which is connected to the controller via a single controller connector.

In one embodiment, the assembly comprises one wiring loom branch for all of the sensors. In this embodiment, the assembly comprises four sensors and a single wiring loom branch. This embodiment preferably has two buses.

In one embodiment, the assembly comprises a T-coupler. In an alternative embodiment, the assembly comprises a cable guide having a controlled bend radius. In a further alternative embodiment, one of the wiring loom branches has an overlapped portion in which the cable is folded back on itself.

In one embodiment, the at least one wiring loom is attached to the flexible mat. In one embodiment, the trampoline further comprises a flexible mat having a continuous pocket extending around the mat at or near the periphery of the mat and the at least one wiring loom is received by the pocket.

In another embodiment, the wiring loom is attached to the flexible mat of the trampoline through the use of clips. In another embodiment, the wiring loom is attached to the rods of the trampoline with clips. In a further embodiment, the wiring loom is attached to the net of the trampoline with clips.

In one embodiment, the assembly comprises one wiring loom branch extending around the periphery of the mat. In an alternative embodiment, the assembly comprises one wiring loom branch extending part of the way around the periphery of the mat and another wiring loom branch extending in the same direction, but further than the one wiring loom branch. In an alternative embodiment, the assembly comprises one wiring loom branch extending around the periphery of the mat in a clockwise direction and another wiring loom branch extending around the periphery of the mat in an anti-clockwise direction.

In one embodiment, the trampoline further comprises a frame, a plurality of resiliently flexible rods, a plurality of fittings coupled to the mat about a periphery of the mat, each rod having a lower end and an upper end, the lower end of each of the rods being retained by the frame and the upper end of each of the rods being received by the fittings. In an alternative embodiment, the trampoline further comprises a frame, a plurality of coil springs coupled to the mat about a periphery of the mat and extending outwardly from the mat, each spring having a first end attached to the mat and a second end attached to the frame.

In accordance with a third aspect of the present invention, there is provided a trampoline comprising a coupling having a first channel for receiving a rod or spring of the trampoline, and a second channel generally parallel with the first channel for receiving a portion of a wiring loom and positioning the portion of the wiring loom adjacent the rod or spring of the trampoline.

In one embodiment, the coupling comprises a flexible material. The flexible material is preferably a textile material. More preferably, the flexible material is a webbing material. The flexible material is preferably folded over itself to form the first channel and folded over itself to form the second channel. The folded flexible material may be secured in the folded configuration by hook and loop fasteners, domes, or zips for example. The channels may be two separate pieces of textile that are connected together, by stitching for example, to form the channels. Alternatively, the channels may be formed by a single piece of material folded to form the two channels.

In one embodiment, the trampoline further comprises a flexible mat having a continuous pocket extending around the mat at or near the periphery of the mat and the coupling comprises an extension of the pocket.

In one embodiment, the trampoline further comprises a flexible mat and the coupling is releasably attachable to the mat. The coupling is preferably releasably attachable to an underside of the mat. The coupling may be releasably attachable by hook and loop fasteners, dome fasteners or zippers, for example.

In one embodiment, the conduit comprises a textile material. Preferably, the textile material is a webbing material. In embodiments in which the channels are formed form separate pieces of material, one piece of material may be stiffer than the other piece of material. For example, one piece may be a webbing and the other piece may be canvas.

In an alternative embodiment, the conduit is a moulded tube. Preferably, the conduit is a moulded foam tube.

In one embodiment, the trampoline further comprises a frame, a plurality of resiliently flexible rods, a plurality of fittings coupled to the mat about a periphery of the mat, each rod having a lower end and an upper end, the lower end of each of the rods being retained by the frame and the upper end of each of the rods being received by the fittings. In an alternative embodiment, the trampoline further comprises a frame, a plurality of coil springs coupled to the mat about a periphery of the mat and extending outwardly from the mat, each spring having a first end attached to the mat and a second end attached to the frame.

In accordance with a fifth aspect of the present invention, there is provided a trampoline having a flexible mat with multiple female components adapted to engage respective multiple male components, each of the male components attaching a sensor to the mat when engaged with the respective female component.

In one embodiment, one or more of the sensors forms part of the respective male component.

In one embodiment, one or more of the male components and the respective sensor are a co-moulded or an over-moulded component.

In one embodiment, one or more of the female components is fixed to the mat such that there is little or no movement between the respective sensor and the mat.

In one embodiment, one or more of the female components comprise keyed features and the respective male component has complementary keyed features.

In one embodiment one or more of the female components are attachable to the respective male component by a cable tie.

In one embodiment, one or more of the female components is mounted at or near an edge of the mat.

In one embodiment the female component and the male component are attached to a top plate on the opposing side of the flexible mat with cable ties that pass through the flexible mat. This secures the sensor to the flexible mat. In another embodiment, the top plate further attaches to the female component using elements that pass through the flexible mat as well as being secured with the rest of the system by cable ties.

In one embodiment, a piercing tool is used to separate the fibres in the flexible mat to allow cable ties to pass through; this tool is removable and is preferably removed before the sensor is secured to the flexible mat. In another embodiment, the top plate contains piercing elements that separate the fibres in the flexible mat to allow cable ties to pass through.

In one embodiment, the flexible mat has four female components. Preferably, the four female components comprise two pairs of female components, each pair defining an axis across the mat. Preferably, the axes are orthogonal.

In one embodiment, the female components comprise pockets.

In one embodiment one or more of the female components are attachable to the respective male component by a fastener. The fastener may be a screw, bolt, or rivet, for example.

In one embodiment one or more of the female components are attachable to the respective male component by one or more respective caps. The one or more caps are suitably engageable with the female component. The one or more caps are preferably snap-fitted to the respective female component. In one embodiment, the sensors comprise one or more accelerometers.

In one embodiment, the trampoline further comprises a frame, a plurality of resiliently flexible rods, a plurality of fittings coupled to the mat about a periphery of the mat, each rod having a lower end and an upper end, the lower end of each of the rods being retained by the frame and the upper end of each of the rods being received by the fittings. In an alternative embodiment, the trampoline further comprises a frame, a plurality of coil springs coupled to the mat about a periphery of the mat and extending outwardly from the mat, each spring having a first end attached to the mat and a second end attached to the frame.

In accordance with a sixth aspect of the present invention, there is provided trampoline comprising a flexible mat, an enclosure for containing a controller, the controller configured to receive input data representing activity of a person or object on the flexible mat.

In one embodiment, the trampoline has a frame and the enclosure is mounted to the frame. The enclosure is preferably mounted to the frame by one or more fasteners. For example, the trampoline may have a plate attached to the frame by a single fastener extending through the plate and into the frame. The enclosure may be snap fitted, fastened, or supported by the plate. Alternatively, the enclosure may be preferably snap-mounted directly to the frame. In another embodiment, a mount may be fastened to the frame such that the enclosure can be attached to the mount. The mount may be fastened using a combination of existing bolts in the trampoline frame and additional fastening elements.

In one embodiment, the enclosure comprises a body portion and one aperture or slot on one side of the body portion, the aperture or slot being adapted for receiving a leg of the frame. In this embodiment, the other side of the body portion is free and not attached to the frame.

In one embodiment, the enclosure comprises a body portion and a single aperture or slot extending through the body portion, thee aperture being adapted for receiving a leg of the frame. The aperture or slot may extend through a centre of the body portion. In a preferred form of this embodiment, the body portion has a slot adapted to receive one side of the leg and the enclosure further comprises a cover adapted to engage the body portion and receive the other side of the leg.

In one embodiment, the enclosure comprises a body portion and a pair of apertures or slots on either side of the body portion, each of the apertures or slots being adapted for receiving a leg of the frame.

In one embodiment, the enclosure has a plurality of compartments. The compartments are adapted to contain various components such as a battery, a printed circuit board, and speakers, for example. The battery compartment is preferably adapted for removably containing the battery in the enclosure.

In one embodiment, the battery compartment is preferably magnetically attachable to the enclosure. In another embodiment, the battery compartment has connection pins which are preferably spring loaded and able to be retracted in order for the battery compartment to be attached and removed from the enclosure.

In one embodiment, the enclosure comprises a polymeric material.

In one embodiment, the trampoline further comprises a frame, a plurality of resiliently flexible rods, a plurality of fittings coupled to the mat about a periphery of the mat, each rod having a lower end and an upper end, the lower end of each of the rods being retained by the frame and the upper end of each of the rods being received by the fittings. In an alternative embodiment, the trampoline further comprises a frame, a plurality of coil springs coupled to the mat about a periphery of the mat and extending outwardly from the mat, each spring having a first end attached to the mat and a second end attached to the frame.

In accordance with a seventh aspect of the present invention, there is provided a trampoline comprising a flexible mat, a barrier net enclosing the flexible mat, a mounting arrangement adapted to fixedly or removably attach a device to the barrier net, the device being adapted to communicate either directly or indirectly with multiple movement sensors mountable to the flexible mat.

In one embodiment, the trampoline further comprises a shade for the device.

In accordance with an eighth aspect of the device, there is provided trampoline comprising a frame, a flexible mat, a plurality of coil springs, a coupling receivable by one of the coil springs of the plurality of coil springs, the coupling being receivable in a cavity formed by coils of the coil spring, the coupling having a passageway for receiving a portion of a wiring loom.

In one embodiment, the portion of the wiring loom comprises a plurality of coils.

The term 'comprising' as used in this specification and claims means 'consisting at least in part of'. When interpreting statements in this specification and claims that include the term 'comprising', other features besides the features prefaced by this term in each statement can also be present. Related terms such as 'comprise' and 'comprised' are to be interpreted in a similar manner.

As used herein the term '(s)' following a noun means the plural and/or singular form of that noun.

As used herein the term 'and/or' means 'and' or 'or', or where the context allows both. The invention consists in the foregoing and also envisages constructions of which the following gives examples only.

BRIEF DESCRIPTION OF THE DRAWINGS

The is further described by way of example only and with reference to the accompanying drawings in which:

FIGS. 9*a* to 9*f* show details of a pocket for attaching a wiring loom to a flexible mat and a coupling for positioning a portion of a wiring loom adjacent a spring element of a trampoline as shown in FIG. 1;

DETAILED DESCRIPTION OF A PREFERRED EMBODIMENT

Figure 1:
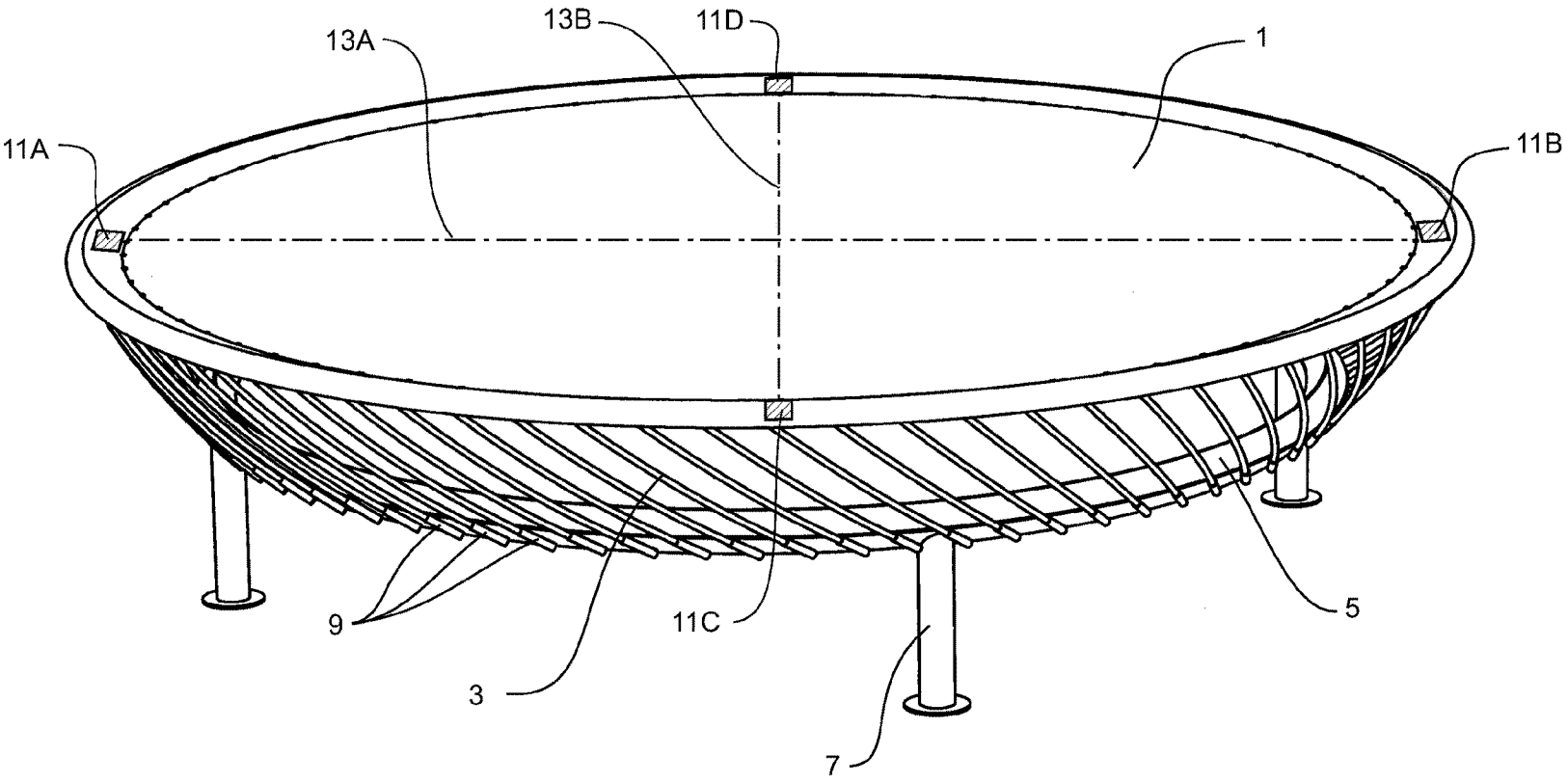
FIG. 1 is a perspective view of a trampoline.
Figure 2:
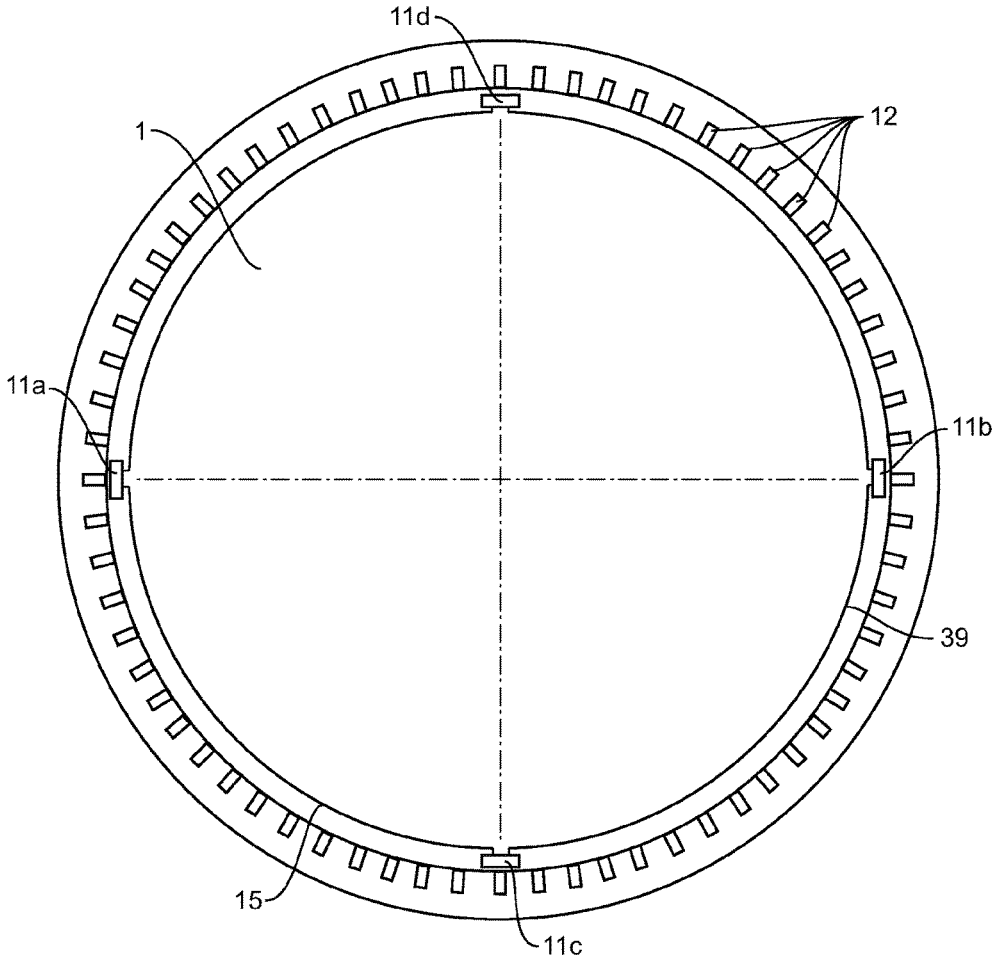
FIG. 2 is a view from below of the trampoline of FIG. 1.

FIG. 1 shows a trampoline comprising a flexible mat 1 on which a person may bounce, cause an object to bounce, or both, a plurality of resiliently flexible spring elements or rods 3 (shown as circular cross-section rods but which may for example alternatively have an oval, square, or rectangular cross-section shape), and a base frame that includes a beam 5 typically formed of steel or aluminium and which may rest on the ground, or alternatively be supported from the ground by legs 7 as shown. In the embodiment shown the trampoline mat 1, and thus also beam 5, has a circular shape in plan but in alternative embodiments may alternatively have a square, rectangular, or oval shape, for example.

The spring rods 3 are typically fibreglass rods but may alternatively be formed of spring steel, for example. The lower ends of the rods are retained by the beam 5. The upper ends of the rods connected to fittings 12 as will be further described below. These fittings 12 are coupled to the mat 1 about the periphery of the mat. The lower ends of the rods 3 may enter into tubular holders 9 fixed to (as shown), or in, the beam 5, but may be coupled to the beam 5 or a base frame of the trampoline of any other form.

Figure 6A:
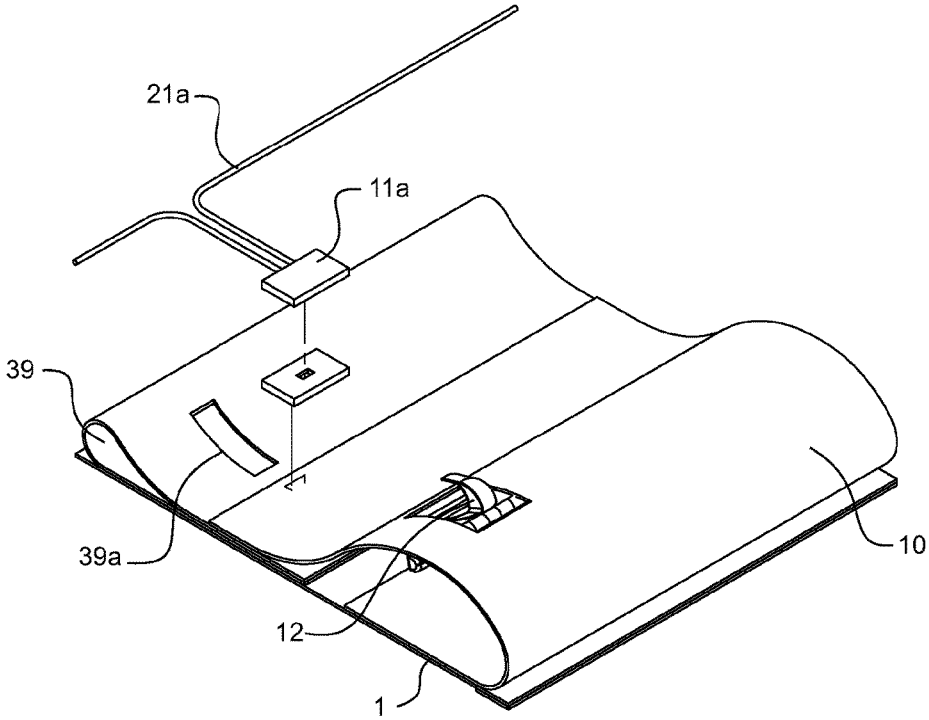
FIGS. 6*a* to 6*c* show a peripheral part of a trampoline mat, and sensor mounting.

The preferred form flexible mat 1 is typically a strong woven synthetic material. It is preferably doubled back upon itself and fixed by stitching for example about the periphery of the mat to form a continuous pocket 10 extending about the periphery of the mat. A plurality of fittings 12 are positioned within this pocket in the peripheral edge of the mat, as shown in FIG. 6*a*. The fittings 12 in one form are loosely captured within the pocket 10. Alternatively the fittings 12 are stitched to the mat within the pocket. In a further embodiment the fittings 12 are mechanically fastened to the flexible mat 1, via rivets for example. The fittings may be attached to the mat and the upper ends of the rods 3 connected to fittings as described in either of U.S. Pat. Nos. 6,319,174 and 8,105,211 the entire contents of which are incorporated herein by reference.

In use as the trampoline is bounced on by a user, this will cause pivotal movement between the upper ends of the rods 3 and the fittings 12 coupled to the mat, to a greater or lesser extent depending upon the size and energy of the user. If the user bounces close to a part of the edge of the mat, significant movement of the rods closest to the point where the user bounces will occur.

Optionally the trampoline may comprise an enclosure as described for example in U.S. Pat. Nos. 7,708,667 and 7,854,687, the entire contents of which are also incorporated herein by reference (see also FIG. 7*f*).

The trampoline can act as an interactive apparatus for providing information and/or entertainment and/or exercise to a user based on activity of the person or an object on the trampoline. The trampoline has a wiring loom assembly 15 including movement sensors, and a controller for processing information from the movement sensors. The wiring loom assembly has: at least one wiring loom branch, at least one controller connector, and multiple movement sensors.

As shown in FIG. 1, a wiring loom comprises two pairs of accelerometers. These accelerometers are shown at 11A, 11B, 11C and 11D. The four sensors 11 are shown as two pairs of sensors arranged equidistantly around the mat. One pair of sensors 11A and 11B define an axis 13A across the mat. Another pair of sensors 11C and 11D define an axis 13B across the mat 1. As shown in FIG. 1, where there are two pairs of sensors, the pairs of sensors may define orthogonal axes across the mat. In an alternative embodiment, the movement sensor arrangement may comprise for example three or more, such as five or six, sensors. The sensors are not necessarily provided as pairs of sensors arranged around the mat. Three sensors may be triangulated.

The sensor or sensors 11 are configured to indicate a value corresponding to a deformation of the mat 1 as a person or object bounces on or otherwise interacts with the mat. The value indicated by the sensor(s) 60 corresponds to a proximity of the person or object to the sensor(s).The term 'deformation' as used in this specification and claims in relation to a mat deformation signal or value includes displacement, velocity and/or acceleration of the mat edge.

The assembly may comprise multiple wiring loom branches. Each of the wiring loom branch may be the same length as the other branches or a different length. The wiring loom assembly may have one sensor for each wiring loom branch. Alternatively, the loom assembly may have two or more sensors for each wiring loom branch. In one embodiment, the loom assembly further comprises at least one bus. Various alternatives are shown in FIGS. 3*a* to 3*e*, each of which schematically shows mat 1 from the underside.

Figure 3A:
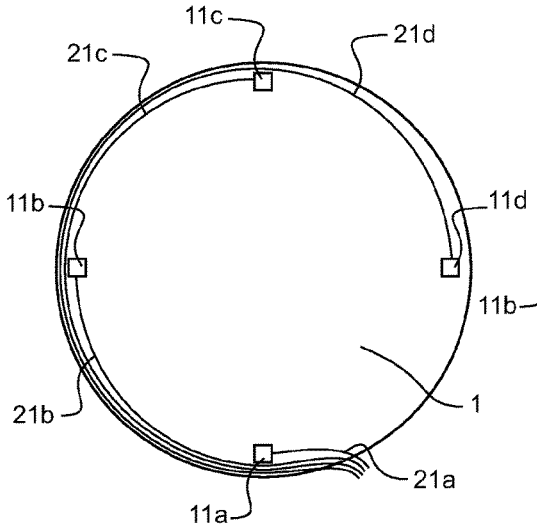
FIGS. 3*a* to 3*e* schematically show alternative wiring loom arrangements from the underside of a trampoline mat.
Figure 3B:
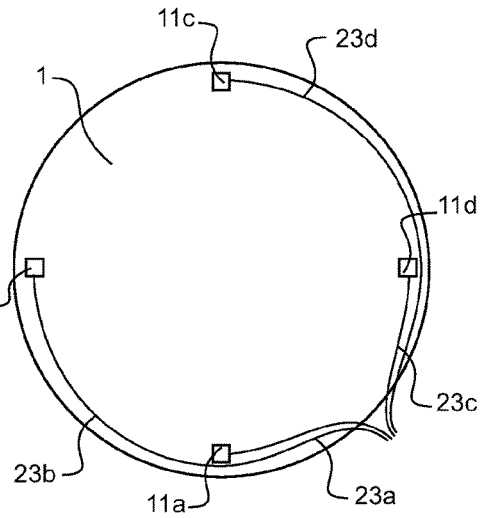
Figure 3C:
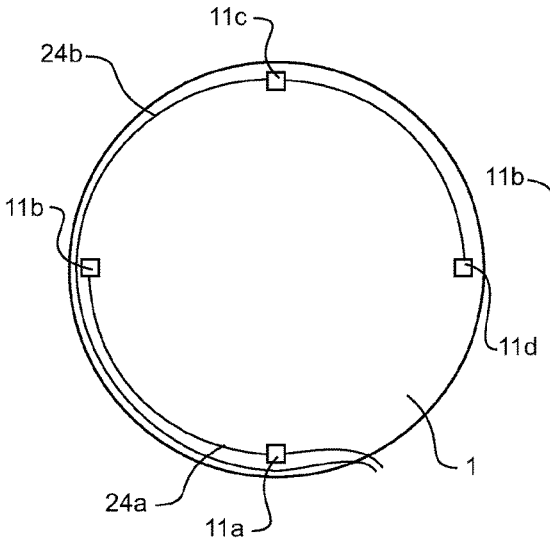
Figure 3D:
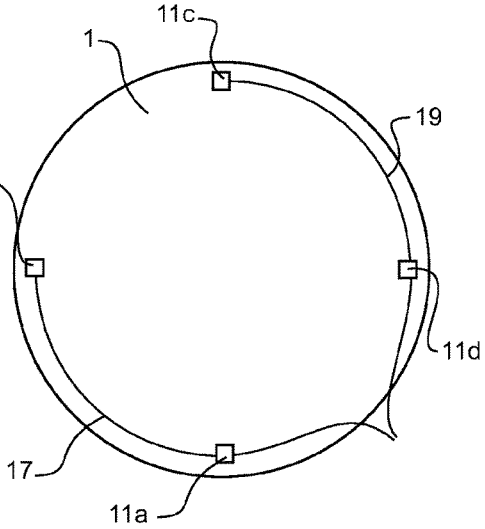

In an embodiment shown in FIG. 3*d*, the wiring loom assembly 15 comprises a first wiring loom branch 17 for a first pair of sensors 11*a*, 11*b* and a second wiring loom branch 19 for a second pair of sensors 11*c*, 11*d*. In this embodiment, the first wiring loom branch 17 is the same length as the second wiring loom branch 19. Each wiring loom branch 17, 19 has one connector positioned at the end of the loom branch and another connector positioned at about the midpoint of the wiring loom. When installed on the flexible mat 1 of the trampoline, the first loom branch 17 extends in a clockwise direction and the second loom branch will extend in an anti-clockwise direction 19 such that the sensors are positioned evenly around the periphery of the flexible mat.

In an alternative embodiment shown in FIG. 3*a*, the assembly comprises one wiring loom branch for each sensor. In this embodiment, each wiring loom branch is a different length to the other wiring loom branches. In particular, the assembly comprises four sensors and four wiring loom branches 21*a*, 21*b*, 21*c*, 21*d* having different lengths. All the loom branches extend in a clockwise direction around the periphery of the flexible mat but may extend in an anti-clockwise direction.

In an alternative embodiment shown in FIG. 3*b*, the assembly may have two relatively shorter loom branches 23*a*, 23*c* having about the same length and two relatively longer loom branches 23*b*, 23*d* having about the same length. In this embodiment, one of the shorter loom branches 23*a* and one of the longer loom branches 23*b* extends in a clockwise direction around the periphery of the flexible mat. The other of the shorter loom branches 23*c* and longer loom branches 23*d* extends in an anti-clockwise direction, such that the sensors 11*a*, 11*b*, 11*c*, 11*d* are positioned evenly around the periphery of the flexible mat.

In another alternative embodiment shown in FIG. 3*c*, the assembly may have one relatively shorter loom branch 24*a* and one relatively longer loom branch 24*b*. In this embodiment, both loom branches extend in a clockwise direction around the periphery of the flexible mat, but both may extend in an anti-clockwise direction. Each loom has two connectors.

Figure 3E:
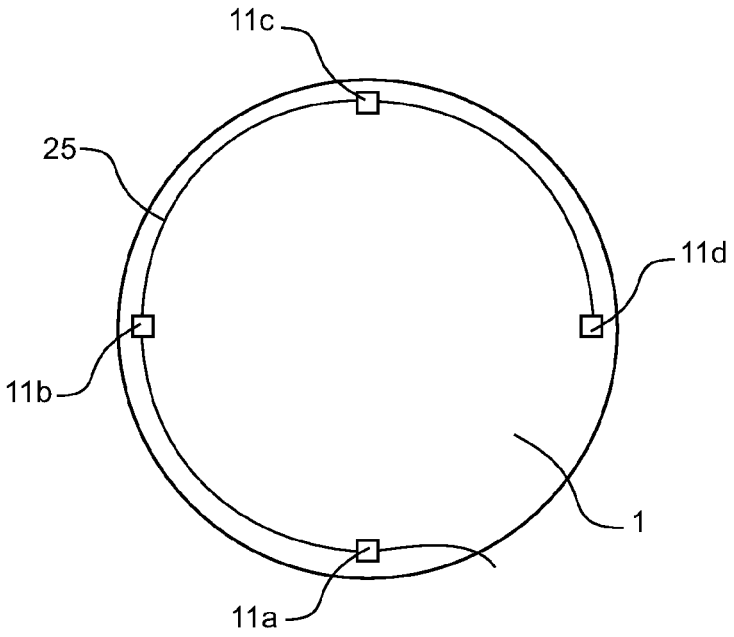

In another alternative embodiment shown in FIG. 3*e*, the assembly comprises one wiring loom branch 25 for all the sensors. In this embodiment, the assembly comprises four sensors and a single wiring loom branch 25. The loom will extend in a clockwise direction around the periphery of the flexible mat but may extend in an anti-clockwise direction. This embodiment preferably has two buses.

Figure 4A:
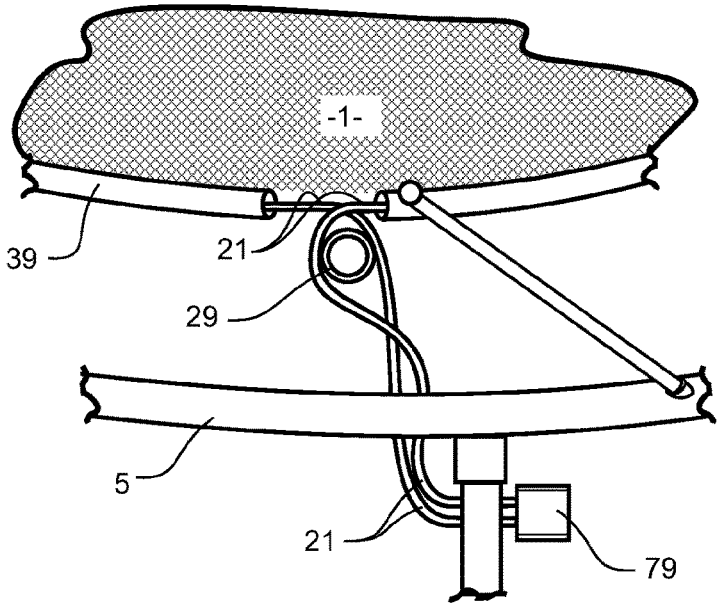
FIGS. 4*a* to 4*c* show alternative options for routing a wiring loom from the trampoline mat to a controller.

With reference to FIG. 4*a*, the assembly 15 may comprise a cable guide 29 having a radius that controls the bend radius of the cable to have a relatively large and smooth radius. The cable guide may be a spool. In this embodiment, the assembly has two wiring loom branches that are connected to the controller 79 by two controller connectors.

Figure 4B:
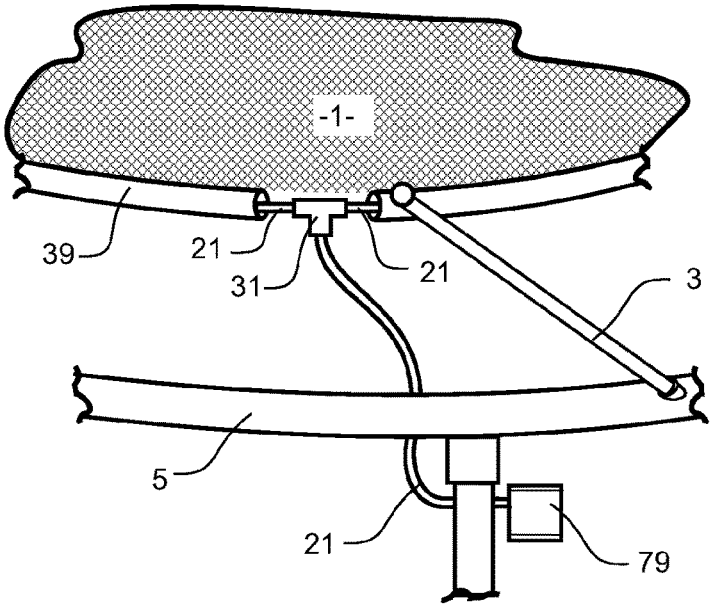

Alternatively, as shown in FIG. 4*b*, each of the wiring loom branches may be connected to a T-coupler 31, which is connected to controller 79 via a single controller connector.

In this embodiment, the T-coupler comprises a connection point between the two cables exiting their respective ends of the continuous pocket 39. Both cables enter the T-coupler preferably without bending and a third cable 21*a* exits the T-coupler at an angle, to be routed down the rod 3 towards controller 79. FIGS. 4*a* and 4*b* do not show all of rods 3 as are shown in FIG. 4*c*.

Figure 4C:
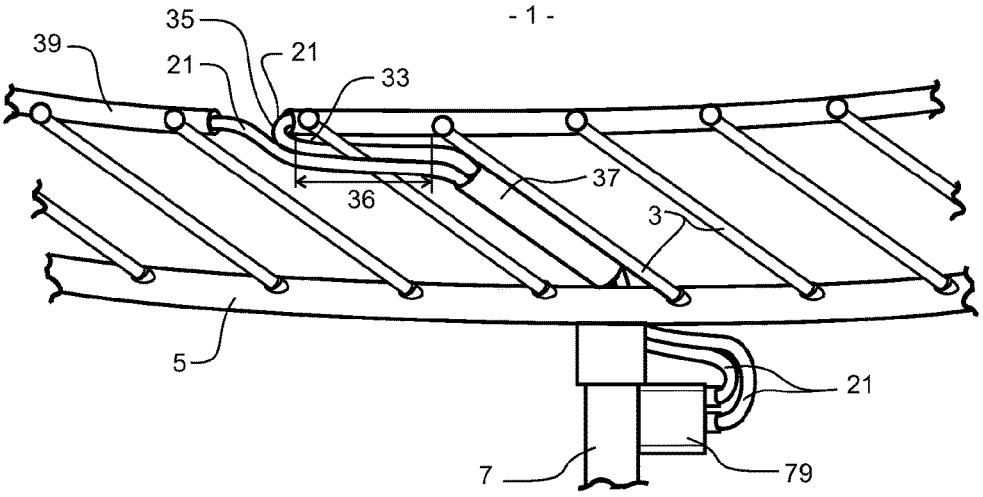

In a further alternative embodiment shown in FIG. 4*c*, one of the wiring loom branches has an overlapped portion 33 in which the cable is folded back on itself as it exits mat pocket 39. The portion of overlapped cable 33 can accommodate surplus cable, if necessary. This embodiment also has a cable length 36 along and under the mat edge, before the cable is then routed down a coupling 37 along rod 3, which is described in more detail below, towards controller 79.

Figure 5:
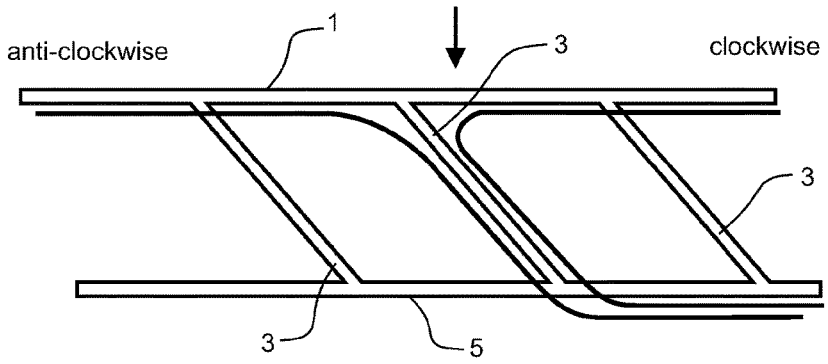
FIG. 5 shows a wiring loom extending between a mat and the frame of a trampoline of FIG. 1.

FIG. 5 schematically shows the routing of the wiring loom branches from the mat 1, along the length of a rod 3, to the frame 5. When a wiring loom branch extends around the periphery of the mat in a clockwise direction, it may follow the path on the right side of FIG. 5. When a wiring loom branch extends around the periphery of the mat in an anti-clockwise direction, it may follow the path on the left side of FIG. 5.

Figure 6B:
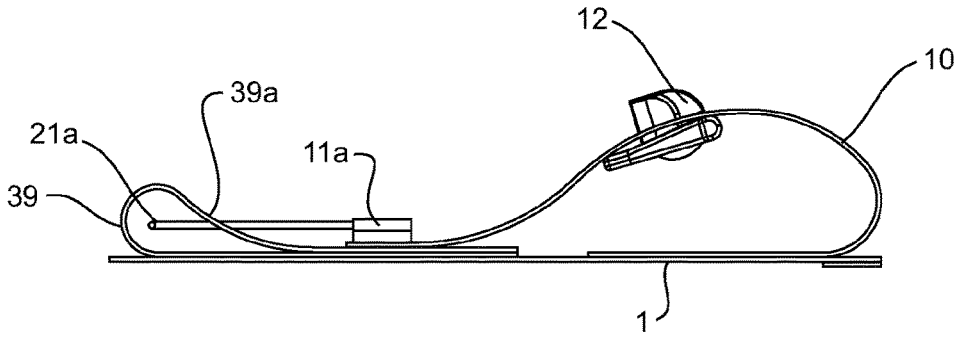
Figure 6C:
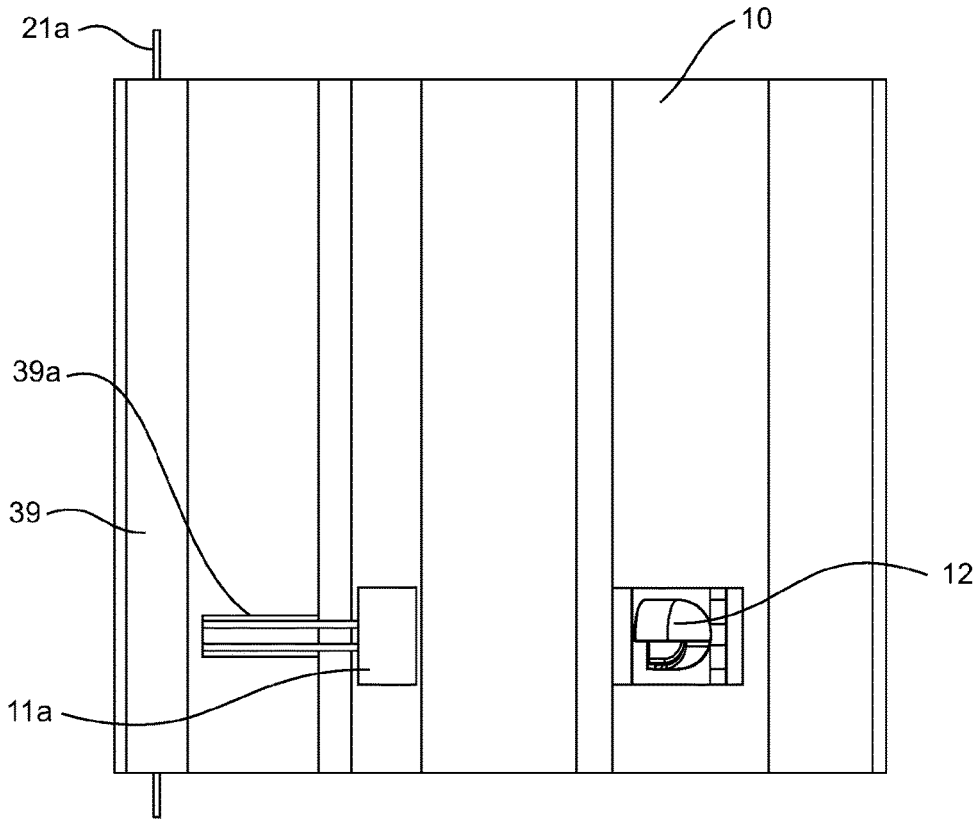

FIGS. 6*a* to 6*c* show one of the wiring looms 21*a* attached to the flexible mat 1. The flexible mat has a continuous pocket 39 extending around the mat at or near the periphery of the mat inboard of the pocket 10 which retains the fittings 12, and when installed the wiring loom 21*a* is extends within the pocket 39. The pocket comprises apertures 39*a* which enable the wiring loom to exit the pocket to each sensor 11*a*. FIG. 6*a* shows the wing loom 21*a* and sensor 11 not installed in the mat.

Figure 7A:
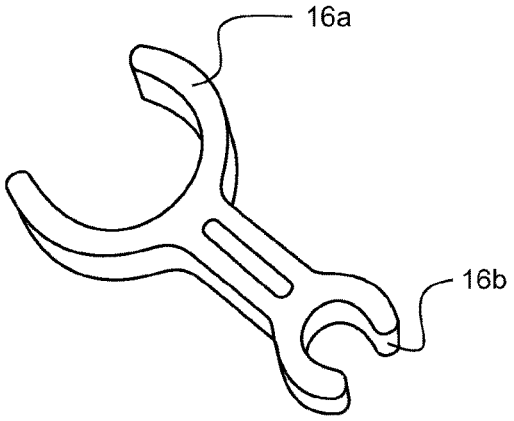
FIGS. 7*a* to 7*c* show three different embodiments of a clip to secure a wiring loom to a trampoline.
Figure 7B:
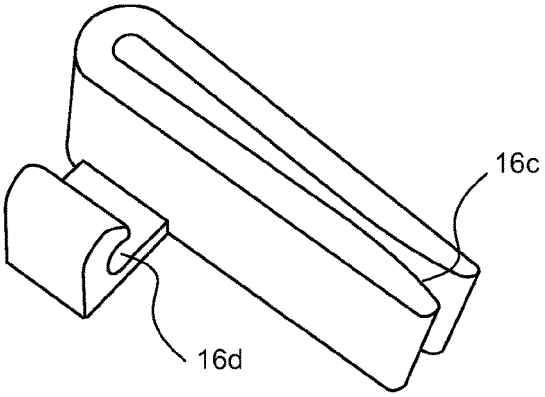
Figure 7C:
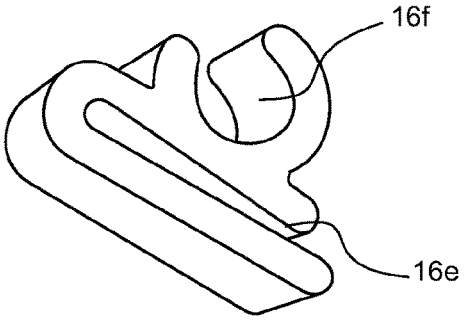
Figure 7D:
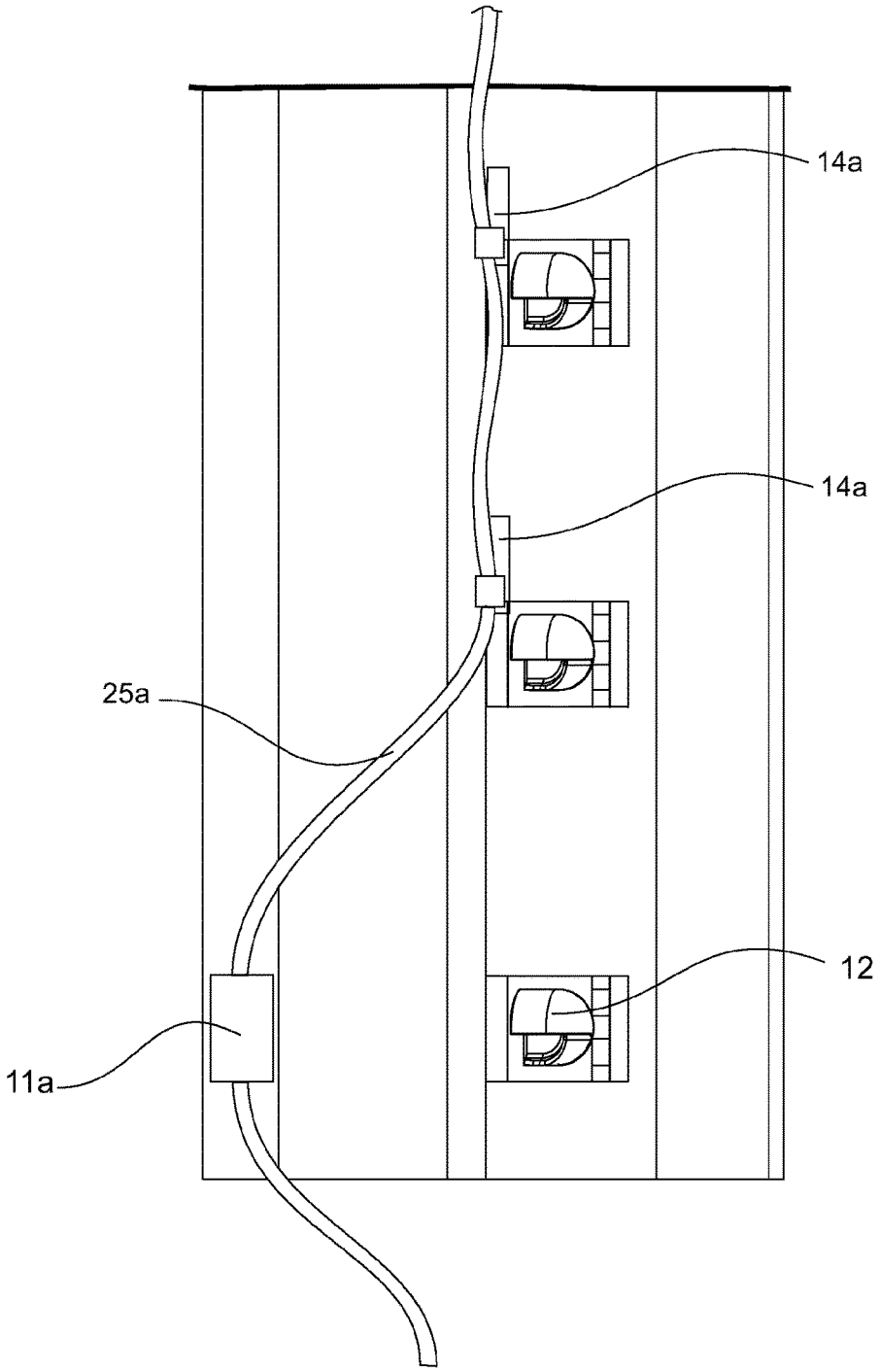
FIGS. 7*d* to 7*f* show the clips of FIGS. 7*a* to 7*c* in use to secure a wiring loom to a trampoline.
Figure 7E:
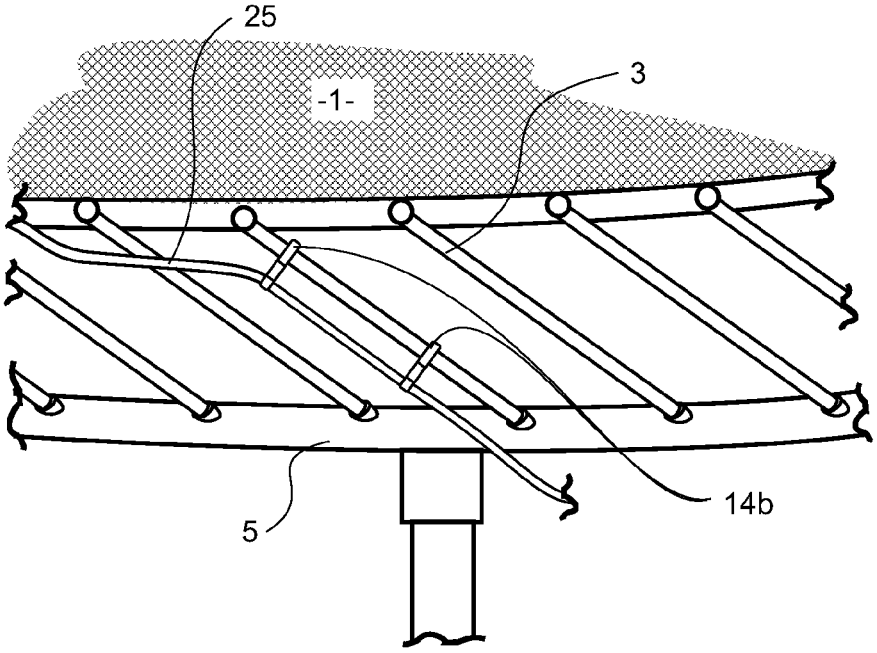
Figure 7F:
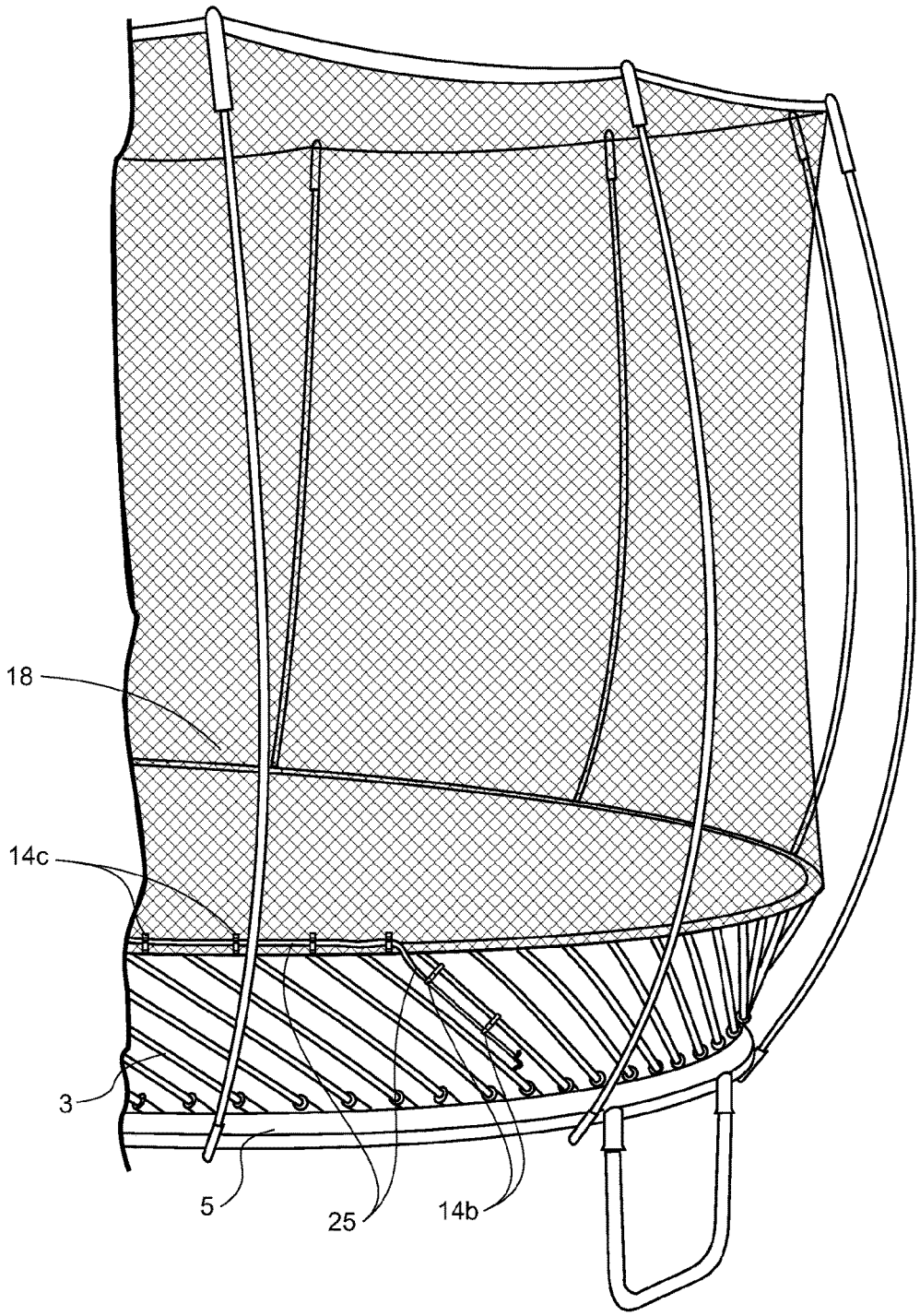

FIGS. 7*a-c* show different embodiments of clips for attaching the wiring loom to the trampoline and FIGS. 7*d-f* show the clips in use. FIG. 7*a* shows a first embodiment of a plastic clip, which has a part 16 at one end designed to snap fit onto a rod 3 and smaller part 16*b* at an opposite end designed to receive and hold the wiring loom 25 and attach a part of the loom to a rod 3 as shown in FIGS. 7*e* and f. FIG. 7*e* shows a wiring loom 25 attached to the trampoline rod 3 using the clip 14*b* shown in FIG. 7*a*. Any number of clips 14*b* can be attached to any number of rods 3 along the length of the trampoline to sufficiently secure the wiring loom 25 to the trampoline.

FIG. 7*b* shows a second embodiment of a plastic clip, for fastening the wiring loom 25 to the underside of the trampoline mat as shown in FIG. 7*d*. The clip which has a part 16*c* designed to slide onto a flap on the underside of the trampoline mat near the periphery of the mat and a perpendicular part 16*d* designed to receive and hold the wiring loom 25. FIG. 7*d* shows one of the wiring looms 25 which is attached to the flexible mat 1 using the clip 14*a* shown in FIG. 7*a*. The clip attaches to any part of the fitting 12 and to any part of the wiring loom with clip 14*a*. Any number of clips 14*a* can be attached along the underside of the flexible mat 1 to sufficiently secure the wiring loom or loom branches 25 to the trampoline.

FIG. 7*c* shows a third embodiment of a plastic clip, for fastening the wiring loom 25 to the bottom of the trampoline barrier net. The clip which has a part 16*e* designed to slide onto the bottom of the trampoline barrier net and a perpendicular part 16*f* designed to receive and hold the wiring loom 25. FIG. 7*f* shows one of the wiring looms 25 which is attached to the bottom of the trampoline barrier net 18 using the clip 14*c* shown in 7*c*. The clip 14*c* preferably attaches to any part of the bottom of the barrier net 18 and to the wiring loom 25 with clip 14*c*. Any number of clips 14*c* can be attached along the bottom of the trampoline barrier net 18 to sufficiently secure the wiring looms 25 to the trampoline.

Now referring to FIGS. 9*a* and 9*e*, the trampoline may have a tubular coupling 37 with a first channel 41 for receiving a rod 3 of the trampoline to attach the tubular coupling to the rod, and a second channel 43 generally parallel with the first channel 41 for receiving and retaining a portion of the wiring loom 21 adjacent the rod 3 to route the wiring loom along the rod. When installed on the trampoline, the coupling 37 extends downwardly from the periphery of the mat. The coupling 37 may be formed of a textile material or a flexible plastics material, folded over itself to form the first channel 41 and folded over itself to form the second channel 43. The folded material may be secured in the folded configuration by hook and loop fasteners 45, domes, or zips for example, as schematically shown in FIG. 9*e* which is a schematic cross-section. Alternatively the channels 41, 43 may be two separate pieces of textile that are connected together, by stitching for example, to form the channels, or by a single piece of material folded and stitched or bonded to form the two channels.

With reference to FIGS. 9*a-d*, mat 1 has a continuous pocket 39 extending around the periphery of the mat and the coupling 37 may comprise an extension of the pocket—see FIG. 9*b*. The pocket 39 is in addition to and generally adjacent to and inboard of the pocket that receives the fittings 12. The pocket 39 may be continuous as described previously with reference to FIG. 6 with apertures 39*a* to enable the wiring loom to extend to the spaced sensors or may alternatively be composed of pocket segments 39*a-d* as shown in FIG. 9*b* with a space between each at which the wiring loom may extend to a sensor. FIG. 9*c* is a schematic cross-section which shows the wiring loom 21, in the pocket 39. FIG. 9*d* is a schematic cross-section of a part of the periphery of the mat of an embodiment in which pocket 39 and the wiring loom does not extend completely around the periphery of the mat.

The coupling 37 is releasably attachable to the mat 1. The coupling 37 is preferably releasably attachable to an underside of the mat. The coupling may be releasably attachable by hook and loop fasteners, dome fasteners or zippers, for example. FIG. 9*f* shows hook and loop fasteners 52 for attaching the coupling to the mat.

In an alternative embodiment the conduit may be a moulded tube such as a moulded polyethylene foam or polyurethane foam tube. The moulded tube preferably has a profile to receive two cables and one rod. It is assembled by the cables being pushed through the apertures and is then pushed over the rod.

The sensors may be fixedly or removably associated with the trampoline, for example as described in PCT patent specification WO 2014/098628 and Australian Innovation patent 2013101110 the entire contents of which are incorporated herein by reference, or as now further described.

Figure 8A:
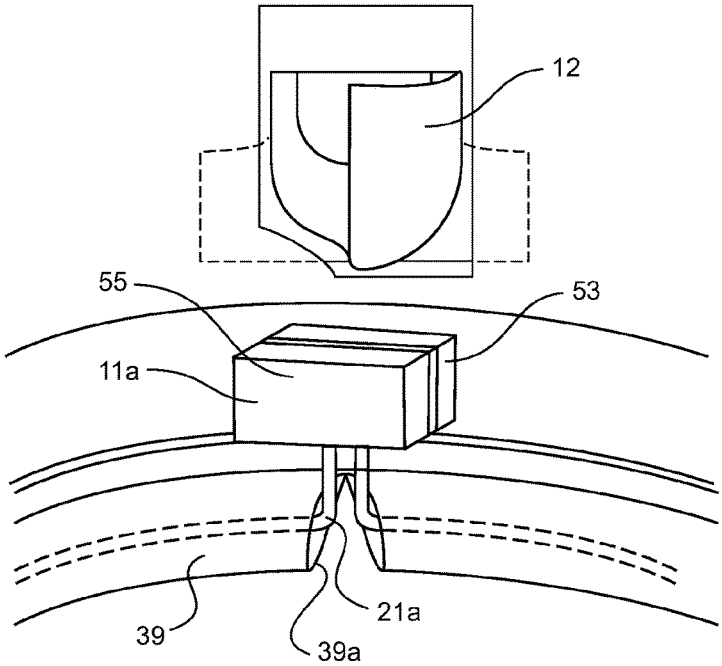
FIG. 8*a* is a schematic perspective view from below a mat showing an accelerometer mounting.
Figure 8B:
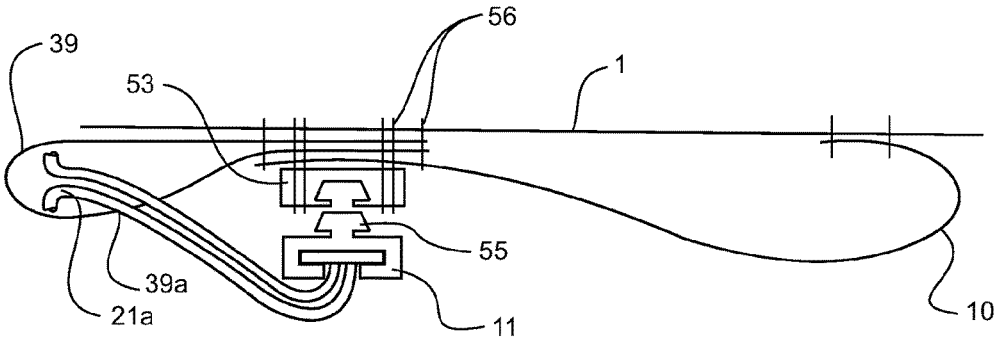
FIG. 8*b* is a cross-section view of an edge of the mat showing the accelerometer mounting of FIG. 7 with the male part detached.
Figure 10A:
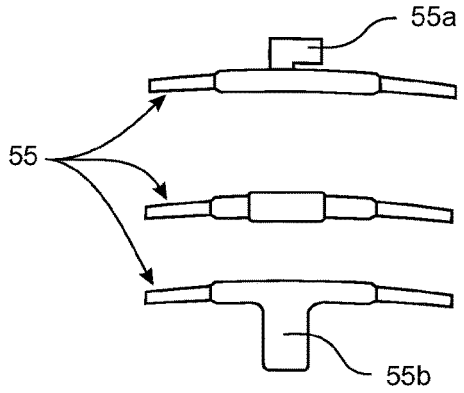
FIGS. 10*a* to 10*d* show alternative overmoulded sensor components.
Figure 10B:
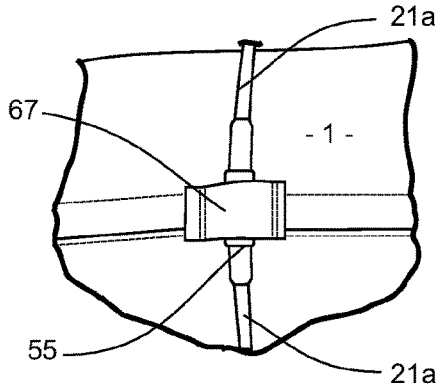
Figure 10C:
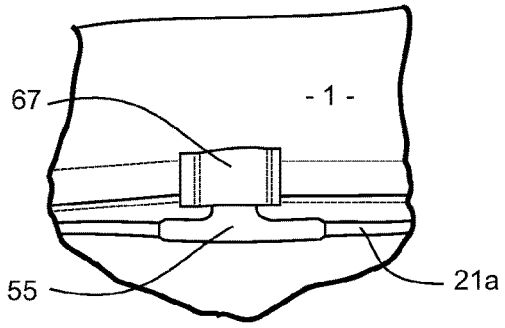
Figure 10D:
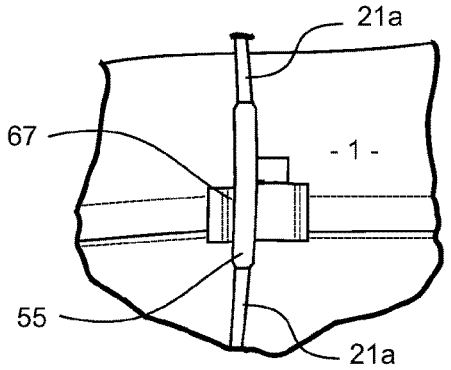

With reference to FIGS. 8*a* and 8*b* which are an underside view and a schematic cross-section view of a part of the periphery of a mat, in the embodiment shown at each sensor mount the mat 1 has multiple female components 53 attached to the mat and each adapted to engage respective multiple male components 55 comprising a sensor. For example parts 53 and 55 may be plastic moulded parts which engage permanently, or detachably (for fault finding or disassembly), in a snap fit. Wiring loom 21*a* in mat pocket 39 as previously described, connects to the male components 55/sensors With reference to FIGS. 10*b* to 10*d*, instead of being for example plastic moulded parts as referred to above, each female component 53 may comprise a fabric or plastic pocket 67 on the underside of the periphery of the mat which receives the male component/sensor 55. For example the pocket 67 may be closed on three sides and open on one side as shown in FIG. 10*c*, or may be closed on two opposing sides and open at the top and bottom as shown in FIGS. 10 b and 10*d*.The male component 55 may have a hook shape 55*a* as shown in FIG. 10*a* that hooks over an edge of the pocket, as shown in FIG. 10*d*. The male component 55 may sit in the pocket in an inline manner as shown in FIG. 10*b* or a perpendicular manner as shown in FIG. 10*c*.The male component 55 may have an extension 55*b* which enters into the pocket as shown in FIG. 10*c*. Or in other embodiments the male component 55 may simply be secured to the underside of the mat by one or more of: stitching, adhesive, or a fastener.

Each female component 53 is fixed to the mat 1 such that there is little or no movement between the respective sensor 11 and the mat. One or more of the female components 53 may be mounted at or near the peripheral edge of the mat 1. Each female component 53 may be sewn into the mat 1 by stitching 56, or plastic welded or bonded to the mat. Alternatively, the female components may be attached to the mat by hook and loop fasteners.

Each of the male components 55 attaches a sensor 11 to the mat when engaged with the respective female component 53. Each sensor 11 preferably forms part of the respective male component 55. As shown in FIG. 10*a*, each male component 55 and respective sensor 11 are a co-moulded or overmoulded component so that the sensors are plastic encapsulated and attached to the wiring loom.

Figure 11A:
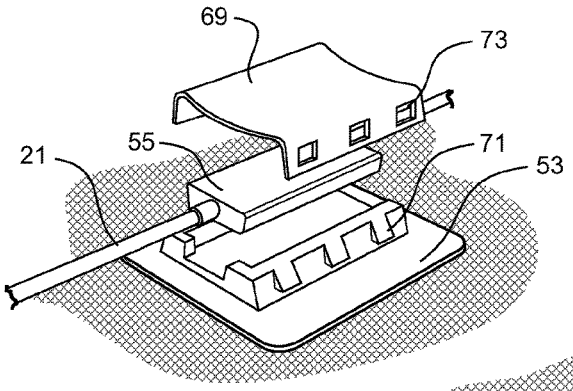
FIGS. 11*a* to 11*d* show alternative mat sensor attachments.
Figure 11B:
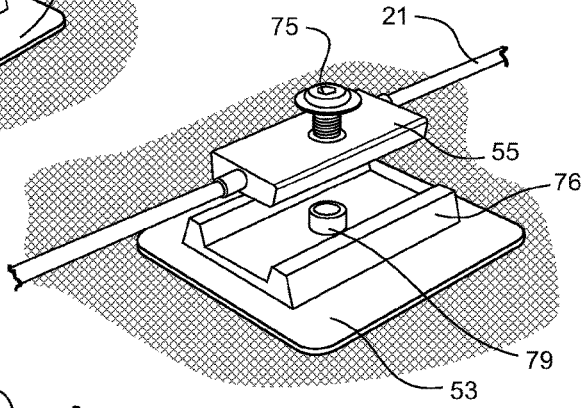
Figure 11C:
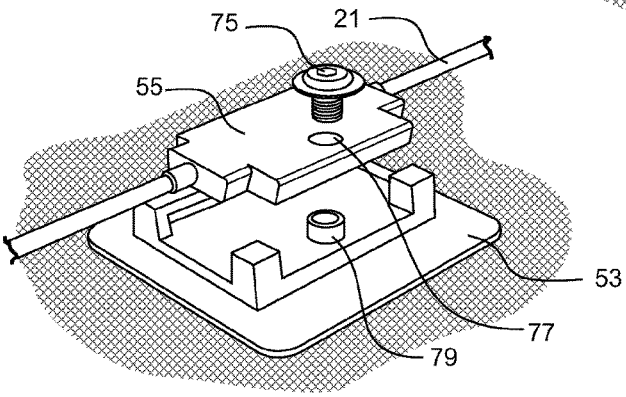
Figure 11D:
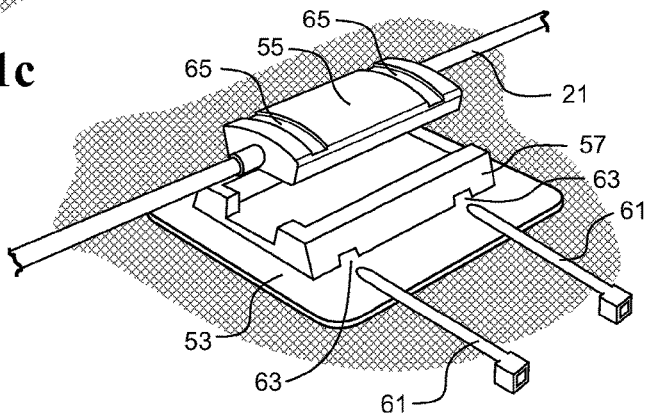

FIGS. 11*a-i* show further sensor mounting embodiments. The female components 53 may comprise keyed features and the respective male component 55 has complementary keyed features. FIG. 11*d* shows the female component 53 with rails 57 for locating and optionally partially securing the male component 55.

In some embodiments the female components 53 may be attachable to the respective male 55 component by a cable tie 61 or pair of cable ties. The female component 53 has a pair of apertures 63 for receiving a portion of the cable ties 61. The male component 55 has corresponding slots 65 for also receiving another portion of the cable ties 61. The apertures 63 and slots 65 ensure the cable ties 61 do not slip or slide relative to the female component 53 and the male component 55.

The cable ties 61 are installed to tie the female component 53 and the male component 55 together. After securing the male 55 and female components 53 together, the excessive portion of the cable tie 61 is removed. As an alternative to the cable ties, the male and female components may be secured using a suitable elastomeric component, such as a rubber band.

With reference to FIG. 11*a*, each female mount component 53 shown may be attachable to the respective male mount component 55 by a cap 69. The cap 69 is suitably engageable with the female mount component 53, for example by a snap-fit to the respective female component. FIG. 11*a* shows clips 71, which snap into apertures 73 of the cap. In addition to a snap-fit, the cap 69 may have additional location features for locating or orienting the cap relative to the female mount component. The cap 69 is preferably selectively releasable by disengaging the snap-fit, which allows the sensors to be removed from the flexible mat. Alternatively, the cap 69 may be permanently fixed to the female member 53.

With reference to FIGS. 11*b* and 11*c*, each female component 53 may be attachable to the respective male mount component 55 by a fastener 75. The fastener 75 may be a screw, bolt, or rivet, for example. The fastener 75 may extend through an aperture 77 in the centre of the female and male mount components (FIG. 11*b*) or an aperture that is offset relative to the centre of the female and male mount components (FIG. 11*c*). The male component 55 may have a boss 79 for receiving the fastener. The boss 79 may be threaded. The fastener 75 may be an alternative to the other attachment methods or additional to the other attachment methods. The female component 53 may have rails 76 for locating the male component 55.

Figure 11E:
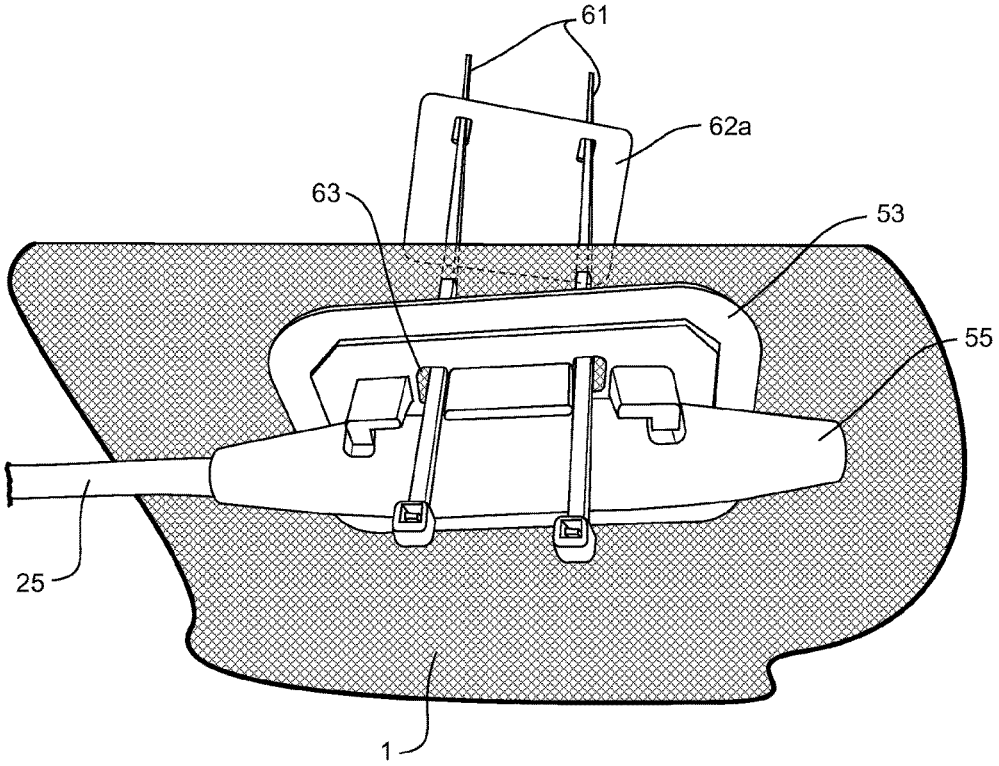
FIGS. 11*e* to 11*i* show alternative sensor mountings to a trampoline mat.
Figure 11F:
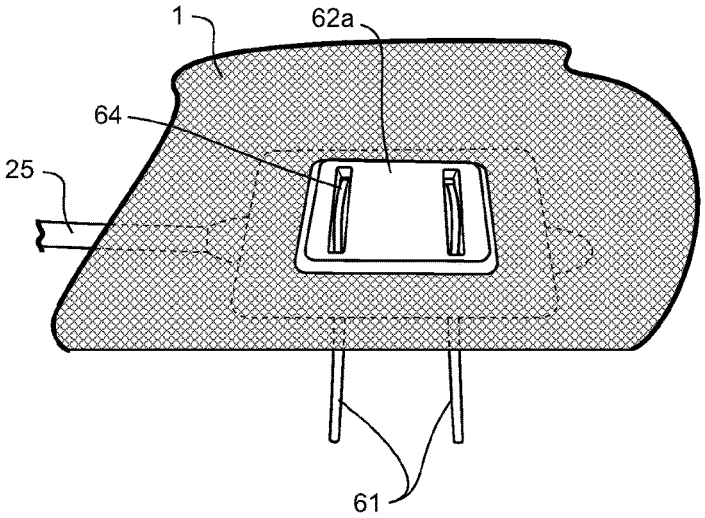

FIG. 11*e* shows another embodiment for attaching the sensors 11 to the flexible mat 1. In this embodiment the female mount component 53 has a flat top part or plate 62*a* on the topside of the flexible mat 1. The top plate 62*a* has apertures for receiving cable ties 61, which pass between the fibres in the flexible mat 1 such that they are able to access both sides of the flexible mat 1. On the underside of the flexible mat 1 to the top plate 62*a*, the male sensor component 55 preferably attaches to or is received within the female component 53 and the cable ties 61 are used to secure the male sensor component 55 to the female underside component 53 through apertures in the female component 53, as well as to the flexible mat 1 and the topside plate 62*a*. The cable ties 61 are preferably held in place by ridges 64 in the top plate 62*a*. It is also preferable that there are slots in the male sensor component 55 to hold the cable ties 61 in place.

Figure 11G:
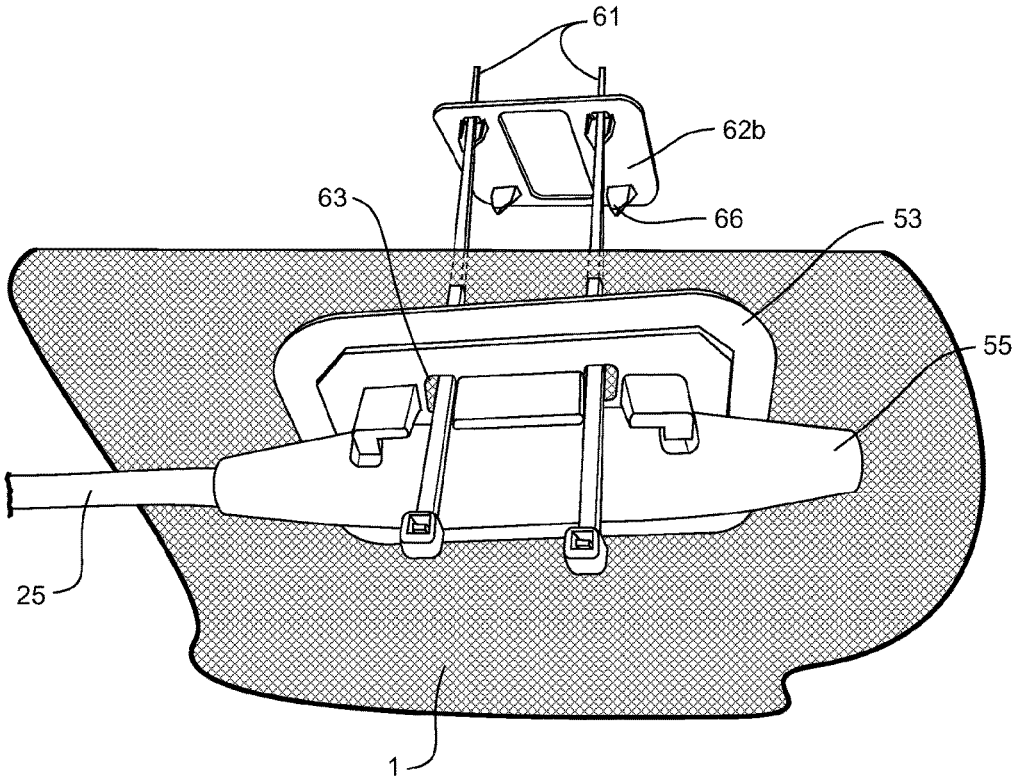
Figure 11H:
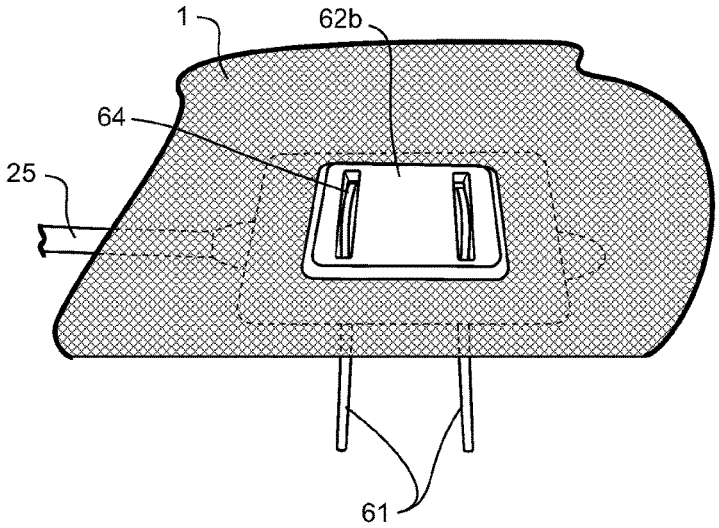
Figure 11I:
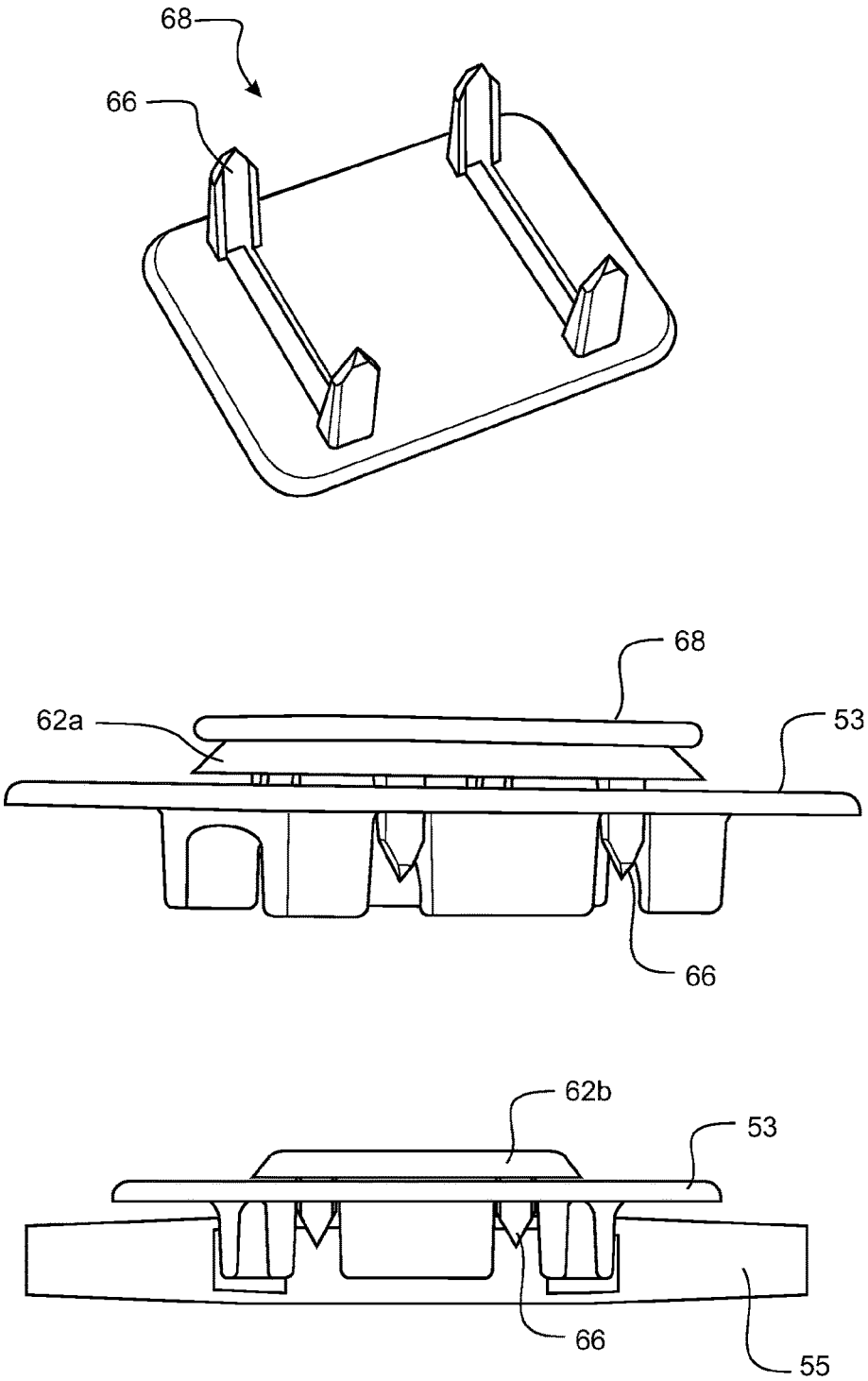

The textile yarns or fibres of the flexible mat 1 can be separated so that the cable ties 61 are able to be more easily passed from one side of the flexible mat 1 to the other through the use of a piercing tool 68 as shown in FIG. 11*i*. This tool preferably acts to part the fibres in the flexible mat 1 to allow the cable ties 61 to be inserted. The tool is then preferably removed and the male sensor component 55 and female component 53 are secured in place and to the mat and top plate 62*a* with the cable ties 61.

Another embodiment for attaching the sensors 11 to the flexible mat 1 is shown in FIG. 11*g*. The topside plate 62*b* sits on one side of the flexible mat 1. This embodiment has piercing elements 66 built in to the topside plate 62*b* . These piercing elements 66 act to part the fibres in the flexible mat 1 much like the tool shown in Figure 11*i*, so that the cable ties 61 can be more easily passed from one side of the flexible mat 1 to the other. The piercing elements 66 also preferably act to attach the topside plate 62*b* to the female underside component 53. The piercing elements 66 may comprise a pointed end adapted to pierce the mat of the trampoline. On the opposing side of the flexible mat 1 to the topside plate 62*b* is the underside female component 53, to which the male sensor component 55 attaches to. The piercing elements 66 may optionally also snap fit into the underside component 53. Cable ties 61 then preferably run through an aperture in the topside plate, through the parted fibres in the flexible mat 1 and a piercing element 66, through an aperture 63 in underside female component 53, around the male sensor component 55, then back through the apertures 63 on the opposing side of the female component 53, back through the parted fibres in the flexible mat 1 and a piercing element 66, and through an aperture in the top plate 62*b* , securing with the other end of the cable tie at any stage to fasten the system in place and complete a loop.

Figure 12A:
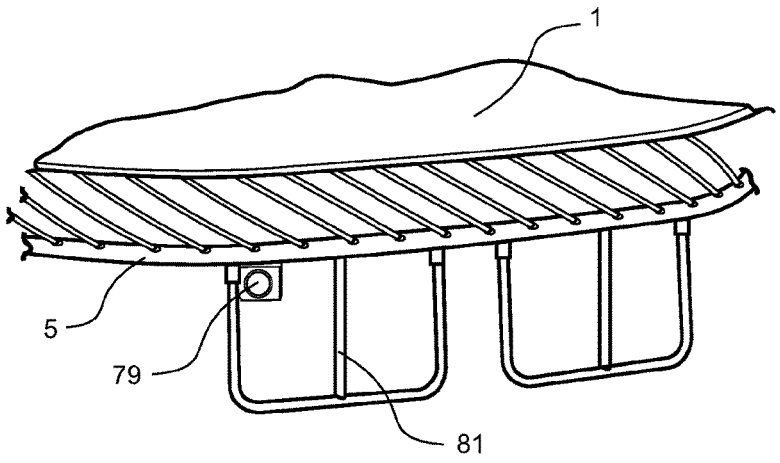
FIGS. 12*a* and 12*b* are part perspective views of a trampoline showing a controller enclosure attached to a frame of the trampoline.

With reference to FIG. 12*a*, the trampoline has a controller 79 configured to receive input data from the mat sensors representing activity of a person or object on the mat 1. The controller is preferably mounted to the frame, for example leg 81. For example, the trampoline may have a plate attached to the frame and the controller which may comprise electronics in a weatherproof enclosure may be snap fitted or fastened to, or supported by the plate. Alternatively, the enclosure may be mounted directly to the frame 81.

Figure 12B:
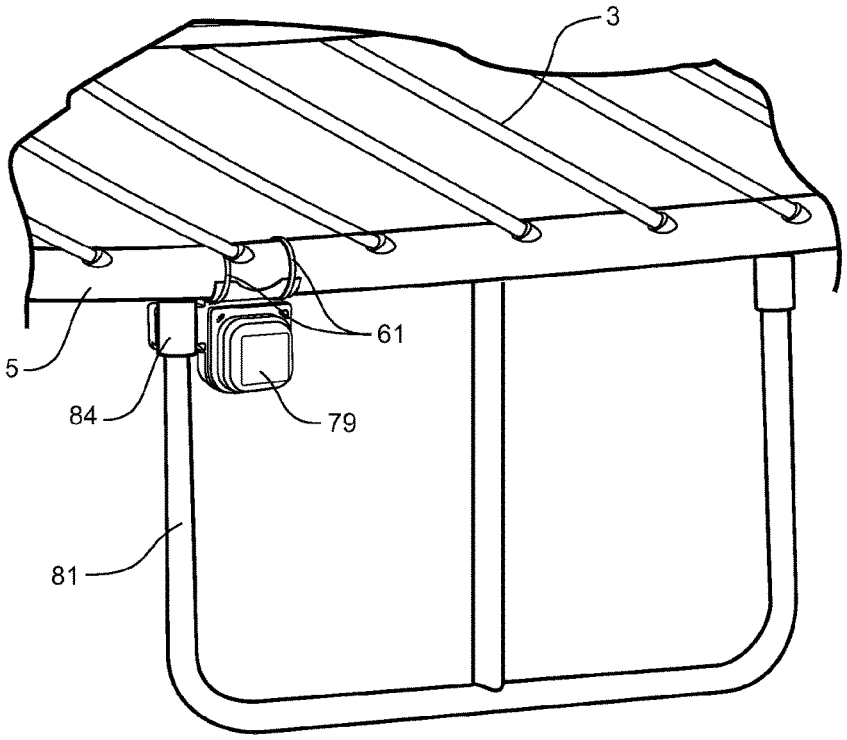

FIG. 12*b* shows an alternative embodiment of a mount 84 adapted to secure the controller enclosure 79 to the frame 81. The mount 84 is preferably secured to the frame of the trampoline using a combination of cable ties 61 and the existing bolts in the trampoline frame 81. Alternatively, the mount 84 may be preferably snap-mounted directly to the frame 81. The controller enclosure 79 may be snap fitted or fastened to, or otherwise supported by the mount 84. Preferably, apertures in the mount 84 may be used to receive the wiring from the sensors which plug in to the controller enclosure 79. In another embodiment, the sensor wiring may be used to attach or secure the controller enclosure to the mount 84.

Figure 13A:
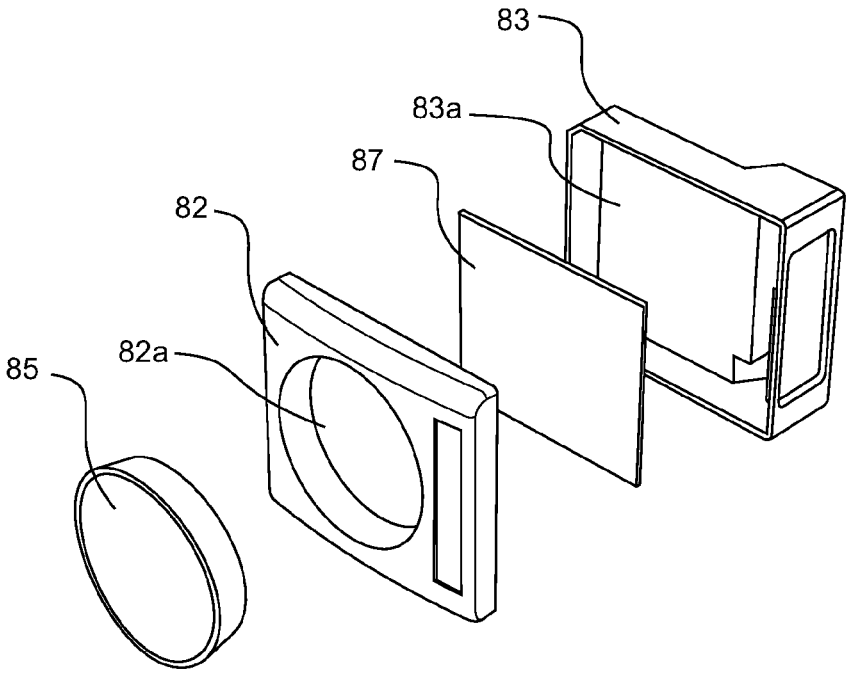
FIGS. 13*a* to 13*c* show an embodiment of a controller and battery enclosure.
Figure 13B:
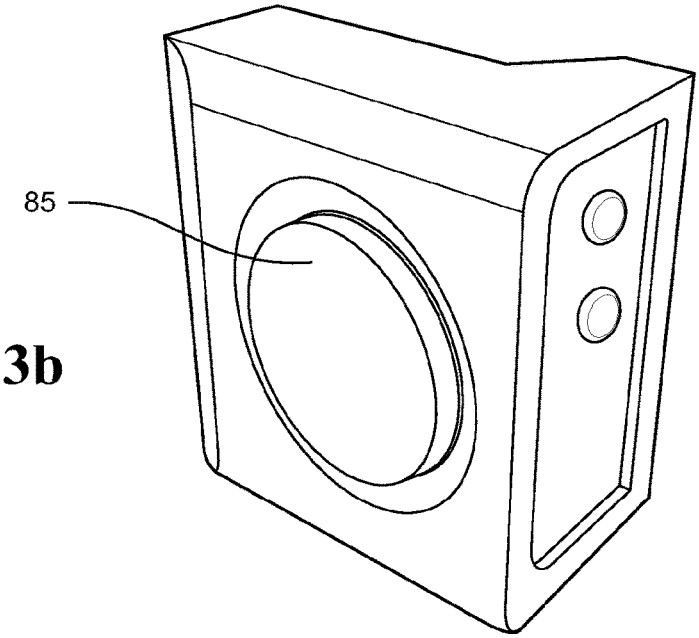
Figure 13C:
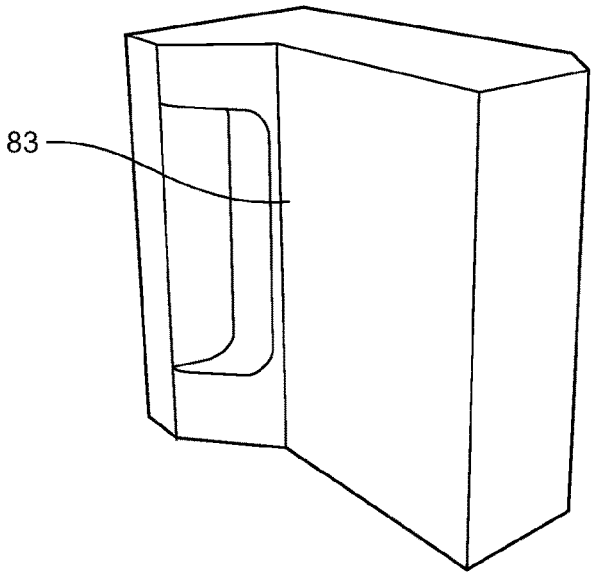

With reference to FIGS. 13*a-c*, in one embodiment the enclosure has a plurality of compartments including a battery compartment 82*a* to contain battery 85, and a backing compartment 83*a* to contain a printed circuit board 87, and speakers, for example. The battery compartment 82 is preferably adapted for removably containing the battery 85 in the enclosure. Enclosure housing parts 82 and 83 shown exploded in FIG. 13*a* fit together to define the enclosure, and enclosure compartments, as shown from the front with battery 85 installed, and from the rear, in FIGS. 13*b* and 13*c*.

Figure 14A:
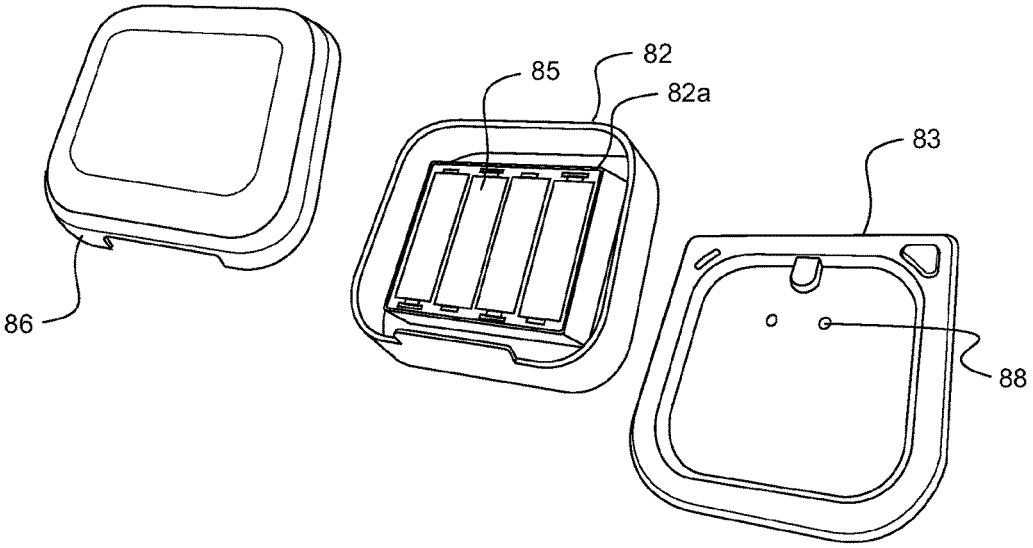
FIGS. 14*a* to 14*c* show another embodiment of a controller and battery enclosure.
Figure 14B:
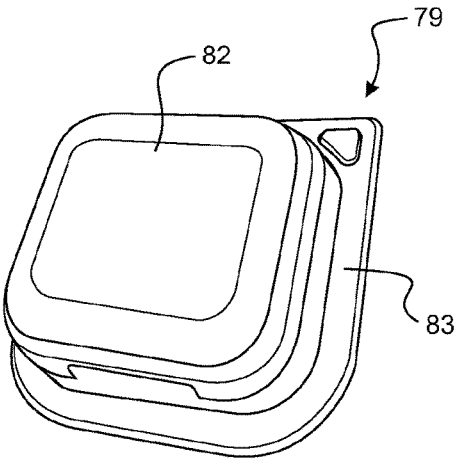
Figure 14C:
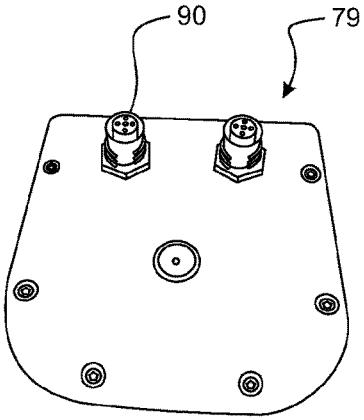

FIGS. 14*a* to 14*c* show another alternative controller enclosure, which also comprises housing parts 82 and 83 which define a battery compartment 82*a* and a backing compartment 83*a*. FIG. 14 a shows the parts separated and FIG. 14*b* shows the assembled enclosure from the front and FIG. 14*c* shows the enclosure from the rear. In this embodiment the battery compartment 82 containing removable batteries 85, has a battery cover 86 to protect the batteries 85 inside. The battery compartment 82 may attach magnetically to the backing compartment 83, and may comprise on a rear wall spring loaded connection pins 88, which connect battery power to the controller through matching contacts on the facing wall of the controller enclosure 83 when the battery compartment 82 is installed. The battery compartment 82 can be removed from the backing compartment 83. With reference to FIG. 14*c*, the back of the compartment 83 has plugs 90 for connecting the wiring from the sensors positioned around the trampoline to the controller.

Figure 15A:
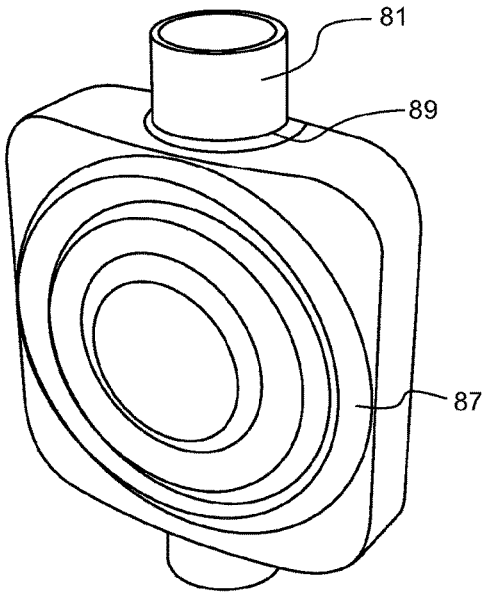
FIGS. 15*a* to 15*e* show further embodiments of a controller and battery enclosure.
Figure 15B:
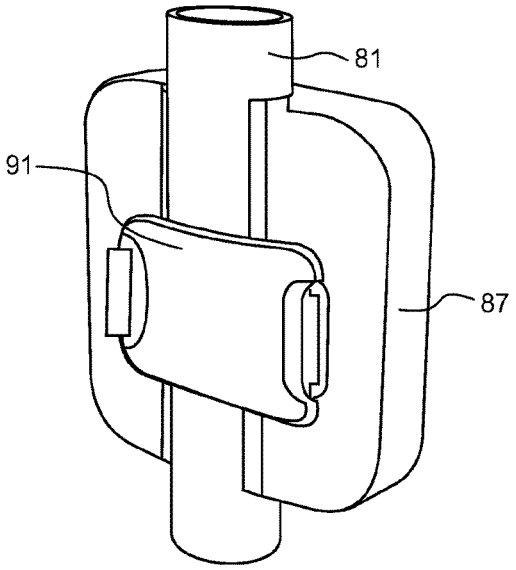

FIGS. 15*a* and 15*b* show a further alternative enclosure comprise 87 comprising a rear vertical aperture or recess 89 adapted for receiving a leg of the frame, and a strap 91 to pass across the rear of the enclosure to capture the frame leg and which is secured to the rear of the enclosure to mount the controller enclosure to the frame leg.

Figure 15C:
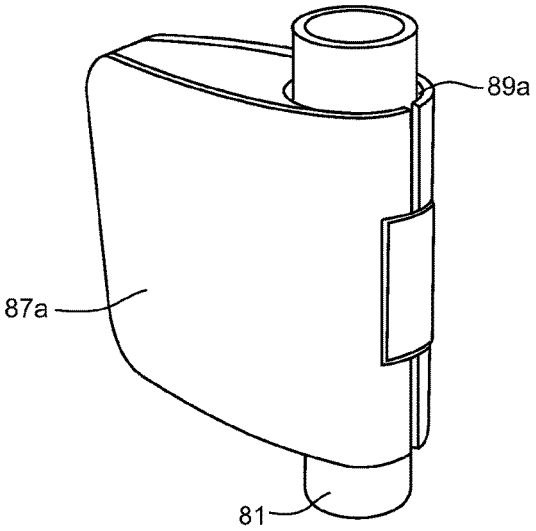
Figure 15D:
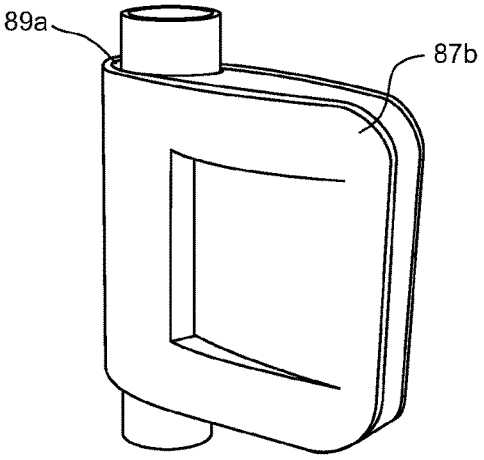

FIGS. 15*c* and 15*d* show a further alternative enclosure comprising two housing parts 87*a* and 87*b* which are fixed together thereby defining an aperture 89*a* on one side of the enclosure in which a frame leg 81 is captured to mount the enclosure to the frame. The other side 85 of the body portion is free and not attached to the frame.

Figure 15E:
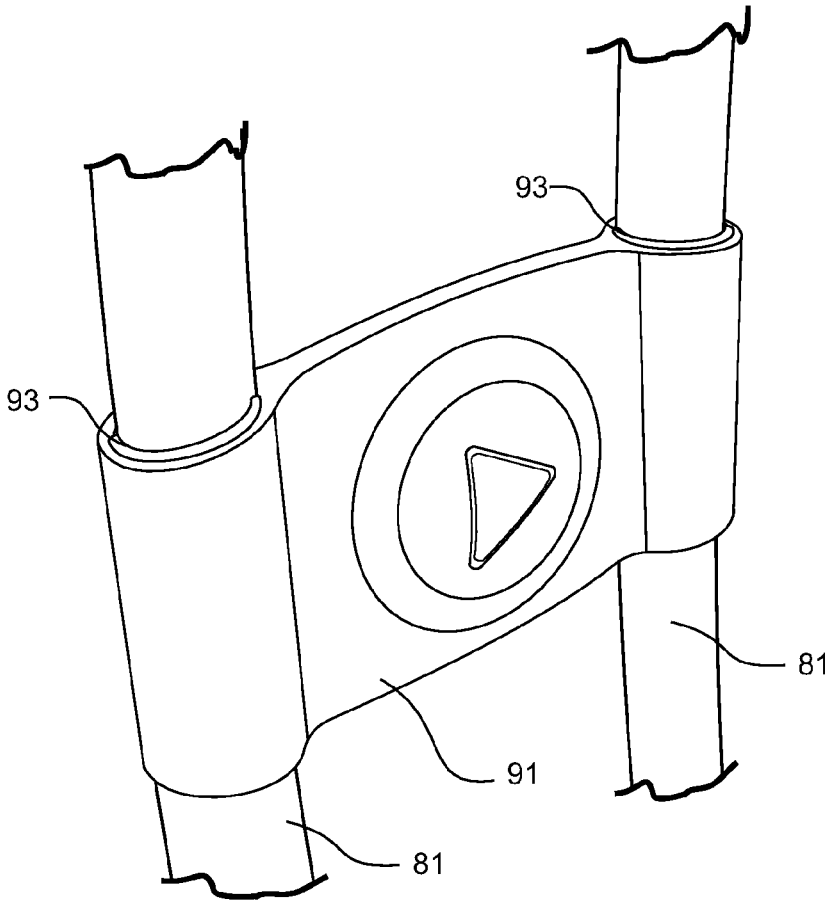

FIG. 15*e* shows another alternative enclosure 91 with apertures 93 on either side, through which pass adjacent legs 81 of the frame to mount the controller enclosure to the trampoline frame.

Figure 16A:
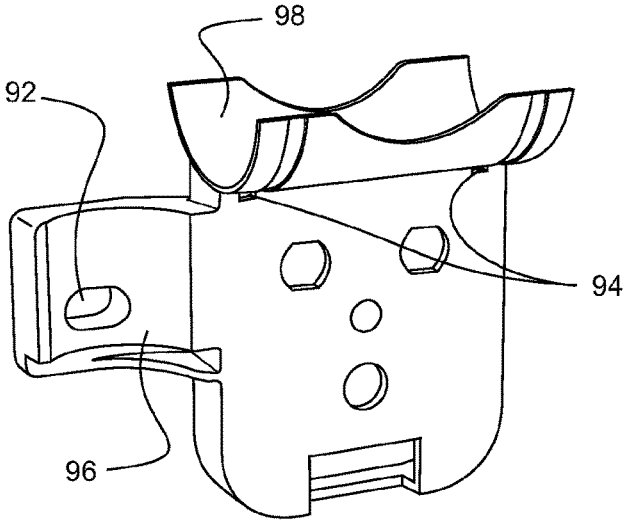
FIGS. 16*a* and 16*b* show a mount for use in securing a controller and battery enclosure to a trampoline.
Figure 16B:
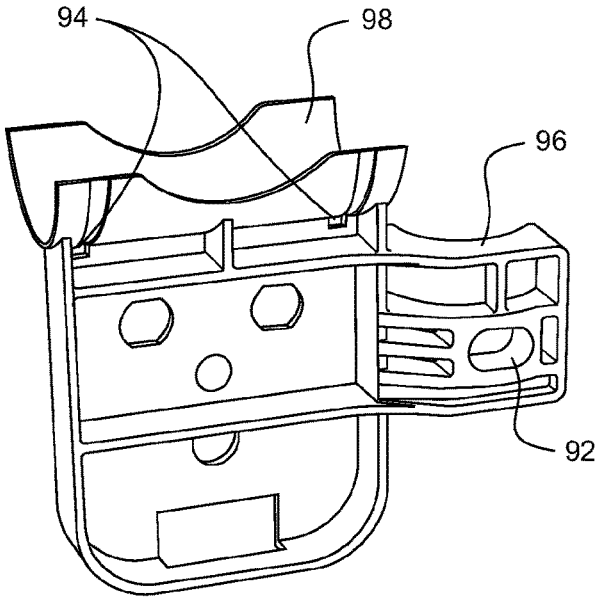

FIGS. 16*a* and 16*b* show an embodiment of a mount used to attach and hold the controller enclosure 79 to the trampoline. The mount 84 is preferably secured to the leg 81 and frame 5 of the trampoline using a combination of cable ties 61 and one or more existing bolts in the frame 81. The aperture 92 is preferably used to secure the mount 84 via an existing bolt, to the trampoline leg 81. Apertures 94 are provided to allow cable ties 61 to pass through which then preferably act to secure around the frame of the trampoline 5. The curved surface 98 is shaped to fit against the frame 5 of the trampoline. Curved surface 96 is shaped to fit to the leg 81 of the trampoline.

The controller enclosure 79 preferably attaches to the mount 84 through the use of fasteners. In an alternative embodiment the controller enclosure 79 is preferably attached to the mount through the use of the sensor wires at the back of the controller enclosure which pass through apertures in the mount in order to be received by plugs 90 in the controller enclosure 79.

The trampoline system may be used with a device such as a tablet computer or a smartphone for example, or alternatively simply a display (VDU) with which the controller interfaces for example wirelessly, and the trampoline may comprise a mounting point including a dock to connect with the device. The device may include a processor, a display, and a user input facility such as for example a touch screen on the device. The device and/or controller operate application specific software that takes as input data representing the bounce zones or locations or other measured activity from the user and uses these inputs to provide gaming information and/or entertainment, or alternatively exercise instruction for example which may include rehabilitation exercise instruction, to a user viewing the handheld device. In use the sensor arrangement is able to communicate either directly or indirectly through a controller mounted to the trampoline frame as described, wirelessly and or via a cable, to the smart device, and in one embodiment, as the user jumps or bounces on the trampoline mat the bounce zones identified by the techniques described above are passed through an application programming interface (API) as input to the controller and/or smart device. The device in combination with the trampoline embodiments described above provide apparatus relating to gaming, communication, rehabilitation and the like. Preferably, the application controlling the device determines the function of the apparatus. In each case, the device provides interaction with the user based at least partly on the activity of the user or an object on the flexible mat. In some embodiments the 'controller' may do not much or any more than act as an interface between the mat sensors and a tablet computer or a smartphone for example on which is running a gaming or exercise application.

Figure 19:
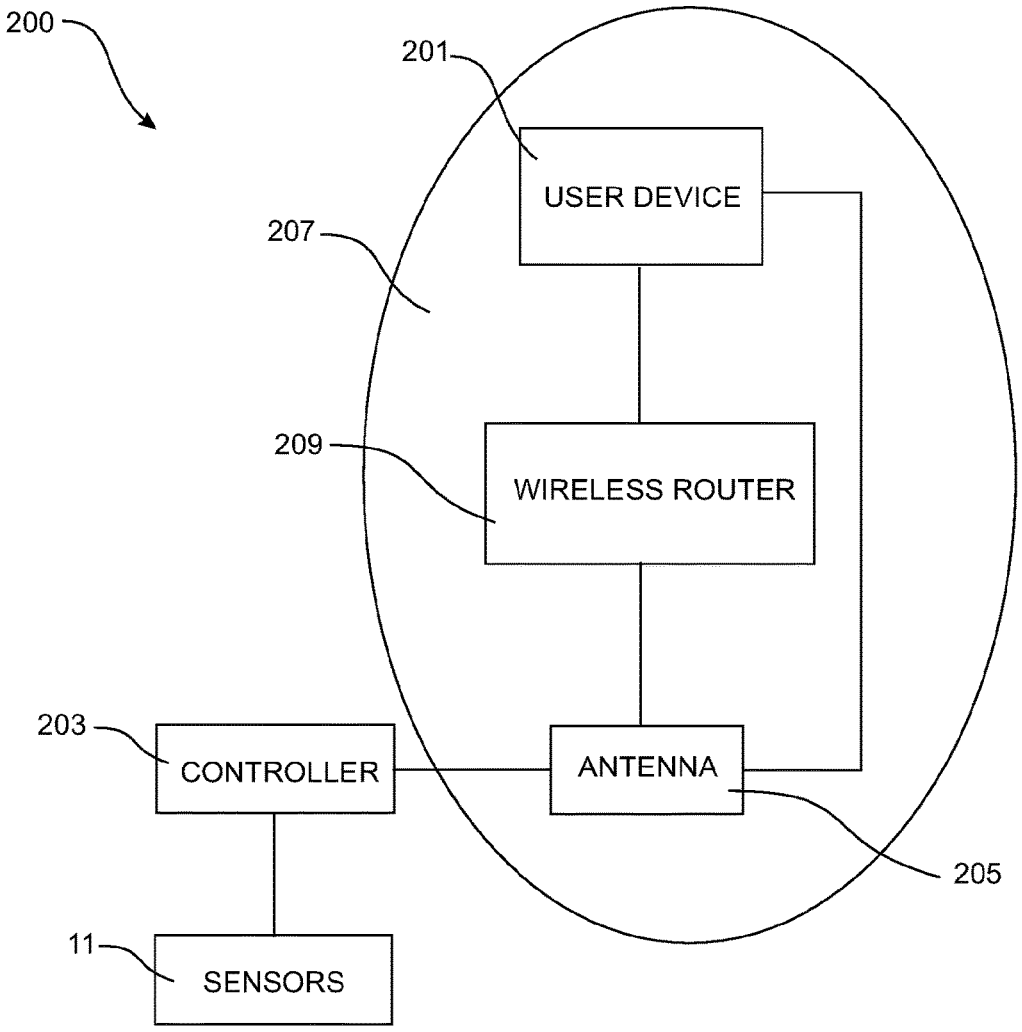
FIG. 19 is a schematic diagram of a preferred form system for transferring data between the sensors of FIG. 1 and a user device.

FIG. 19 shows a schematic diagram of a preferred form system 200 for transferring data between the sensors 11 and a user device 201. As a person bounces on the flexible mat 1, 101, the force exerted on the flexible mat is detected by the sensors 11.

The sensors 11 are connected to a controller 203 configured to interpret signals from the sensors 11 and determine bounce locations using for example the techniques described in PCT patent specification WO 2014/098628. Controller 203 includes or is connected to antenna 205. The antenna in turn is configured to establish a wireless data connection with the user device 201.

In an embodiment, the antenna 205 establishes a connection with user device 201 directly using Bluetooth pairing or Wi-Fi Direct. In another embodiment the antenna 205 establishes a connection with the user device 201 through a traditional wireless network 207 established by wireless router 209. As the user jumps or bounces on the flexible mat 1, the bounce zones identified by the techniques described in PCT patent specification WO 2014/098628 are passed through an application programming interface (API) as input to the user device 201. In an embodiment, the API provides one or more of the following data items to the user device 201 at bounce impact:

Notification that an impact has happened;
Number of bounces since controller was activated;
Height of the previous bounce;
Time spent in the air in the previous bounce.

The controller 203 determines the bounce location of the user between the time of user impact and user departure. In an embodiment the controller 203 determines the bounce location shortly before user departure, or at least closer to user departure than user impact. Once the controller 203 determines user bounce location the API provides to the user device 201 a representation of bounce location. One example format includes the location in polar coordinates relative to the centre of the trampoline. At bounce departure, in an embodiment, the API provides one or more of the following data items to the user device 201:

Notification that the user has departed the mat;
Time spent on the mat during user bounce.

An application running on user device 201 initialises controller 203 by specifying which data the application wishes to receive. The controller 203 then responds with event packets as they occur.

Figure 20:
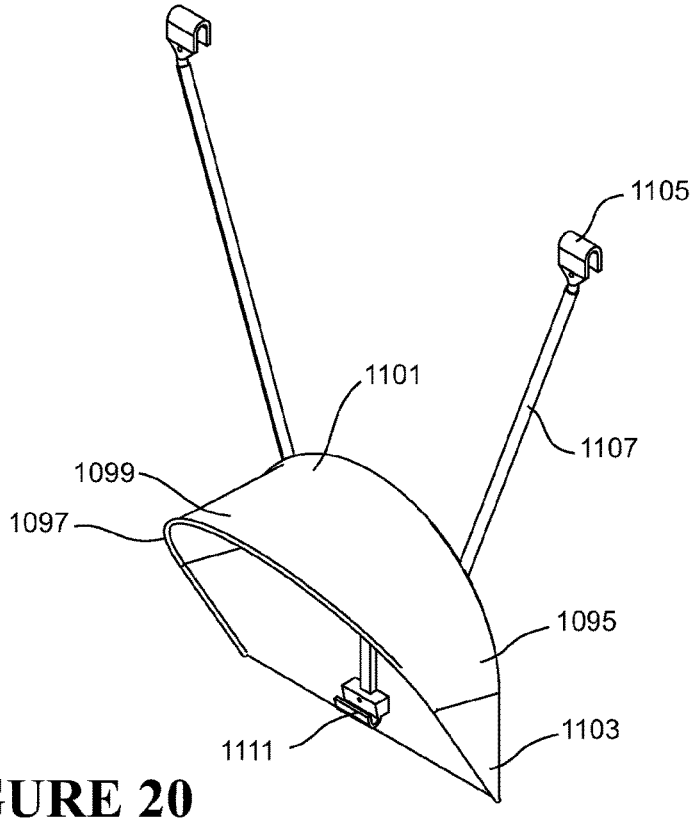
FIG. 20 is a perspective view of a device or display mount and shade.
Figure 21:
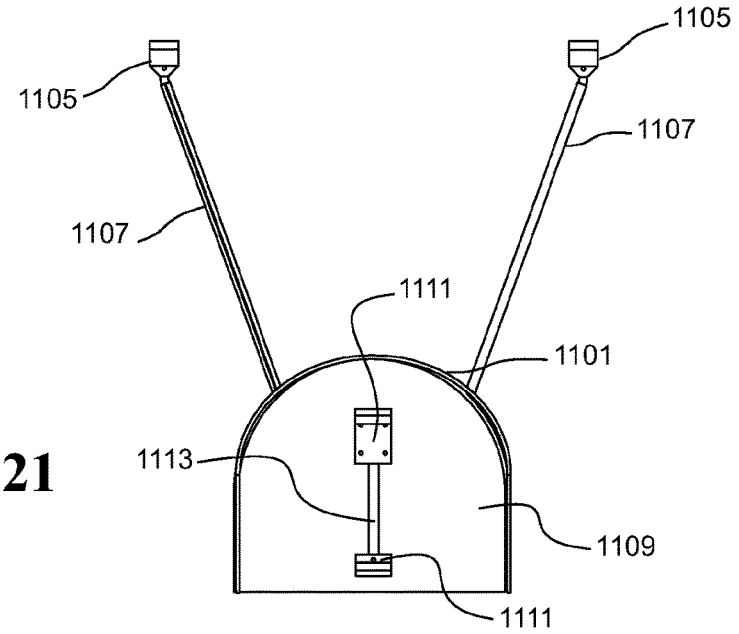
FIG. 21 is a front view of the device or display mount and shade of FIG. 20.
Figure 22:
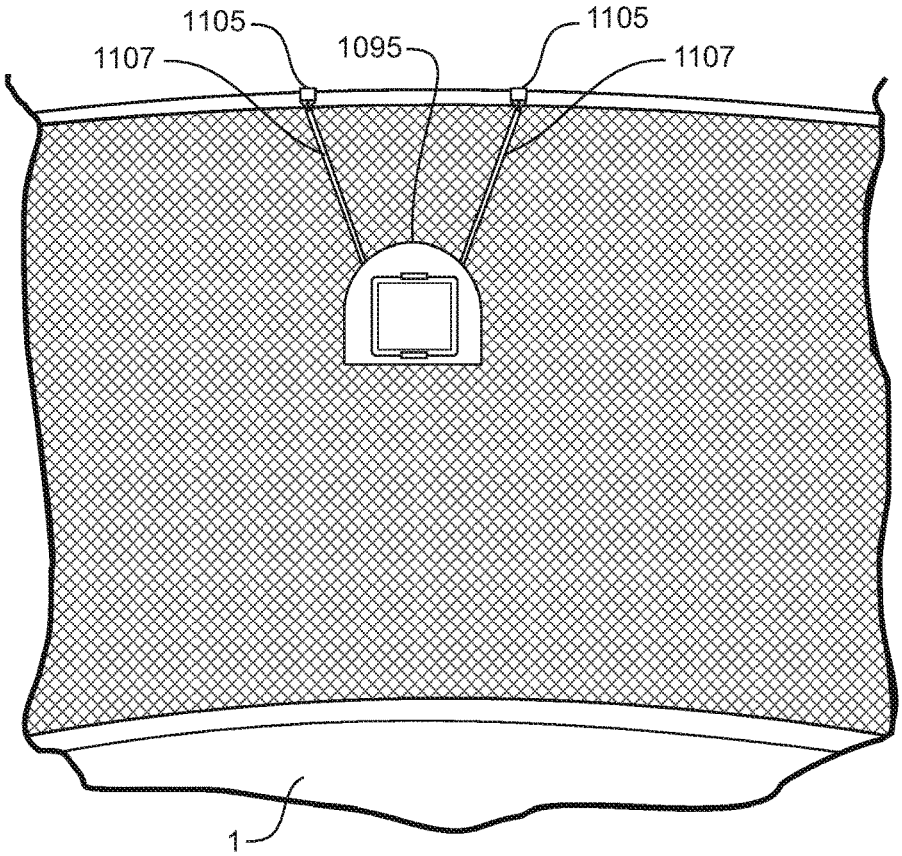
FIG. 22 shows the device or display mount and the shade attached to a barrier net.

FIG. 20 is a perspective view of an embodiment of a device or display mount and shade, FIG. 21 is a front view of the device mount and shade of FIG. 20, and FIG. 22 shows the device mount and the shade attached to a barrier net. The device mount is adapted to be fixedly or removably mounted to the top edge of an enclosure net around the trampoline, as shown. The mount comprises a sun shade 1095. The shade 1095 has a frame 1097 having relatively rigid rods that support a flexible material. The shade 1095 protects device or display 1115 from sun, making the device easier to see by a user. The shade 1095 may also provide the device with some weather protection. The shade 1095 shown in FIGS. 20 to 22 has a bonnet-type shape with a curved upper portion 1101 and triangular shaped side portions 1103. In alternative embodiments, the shade 1095 may have other shapes, such as a flat rectangular upper portion and rectangular or triangular side portions. The shade is preferably suspended by hooks 1105 from the top edge of the enclosure as shown in FIG. 22, with an arm 1107 extending from each hook to the shade. The back portion 1109 of the shade is suitably adapted for receiving and supporting the device. In particular, the back portion has opposing upper and lower hook-type connectors 1111 that receive and support the device 1115. The hooks have a slider 1113 mechanism to allow the distance between the hooks to be adjusted to suit the device in use and ensure a secure hold of the device. The slider mechanism has a slider 1115 with an aperture that receives and slides along a slide bar.

Figure 23:
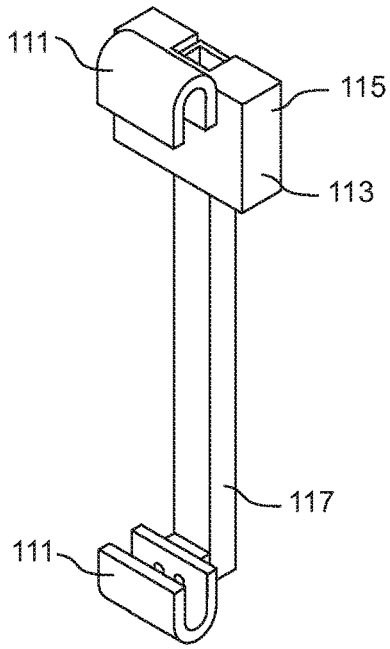
FIG. 23 shows a mount for a device or display for attaching same to a trampoline.

FIG. 23 shows another embodiment of a mount for a device or display for attaching same to a trampoline. In this embodiment the mount comprises a frame element 117, which may optionally be tubular for example with a friction material lining its interior so that the mount can be attached to a support pole or rod of an enclosure net around the trampoline by being slid over the pole and slidably adjusted to the desired height. Alternatively the frame element 117 may be fixed to the enclosure support pole or rod by brackets or clamps for example. At lower and upper ends the frame element 117 has u-shaped holders also preferably padded, for holding a tablet computer or display. The upper u-shaped holder is carried by slider 113 on the frame element 117 so that it can be slidably adjusted to enable the mount to accommodate arranges of sizes of tablet or display.

In alternative embodiments, the smart device or display mount arrangement may comprise one or a combination of straps, hook and loop fasteners, elastic components, clips, hooks, dome fasteners, rivets, screws, a surrounding housing, snap-fit components or supports for attaching the device to the shade or to the barrier net. Those components may support two or more corners of the device, two or more sides or edges of the device, or a back surface of the device, or a combination of corners, edges, and surfaces. Those components may be adjustable, for example, by moving closer to or away from other connector(s), have expandable lengths or widths, or have movable parts to increase/decrease the grip on the device to increase/decrease the grip on the device. The mounting device may also allow for the angle of the screen relative to the user to be adjusted. The mounting arrangement may suspend the smart device or display 1115 inside or outside the barrier net.

Figure 17A:
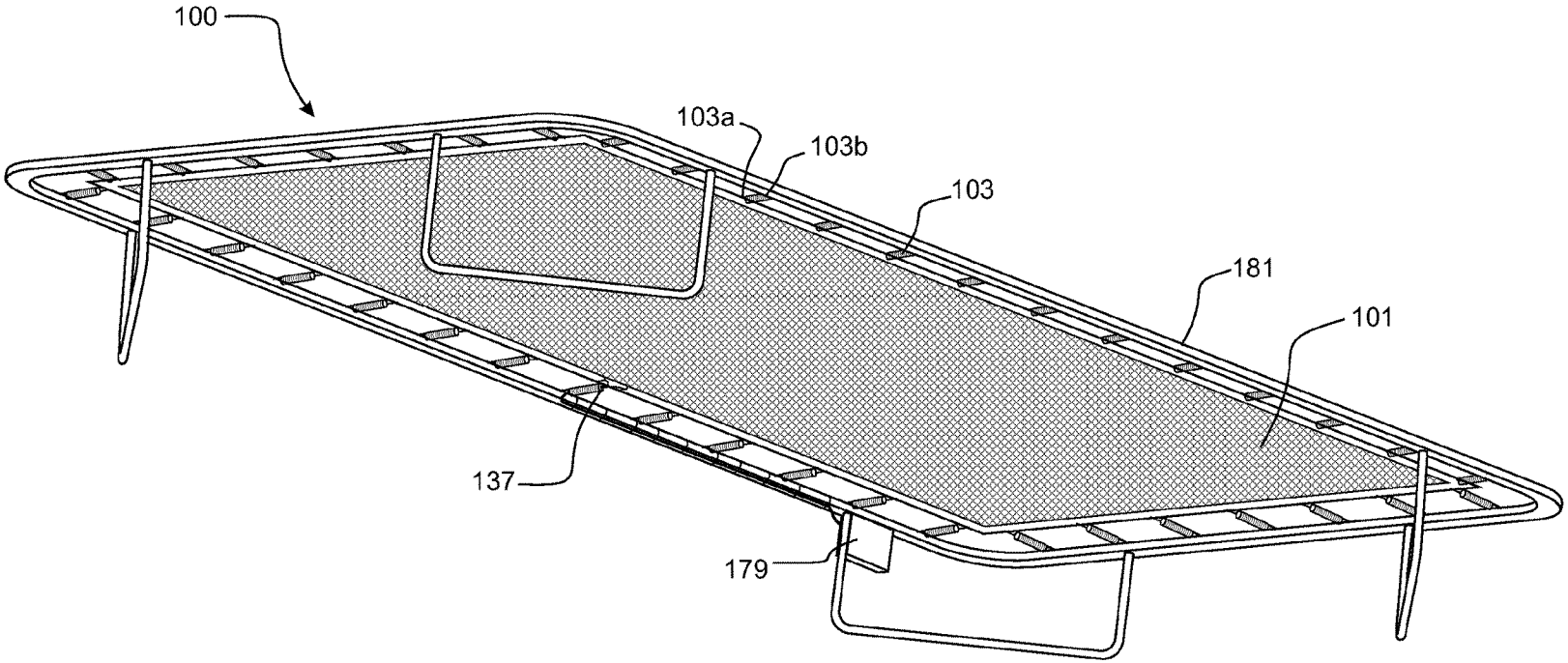
FIG. 17*a* is a perspective view from below of another trampoline.
Figure 17B:
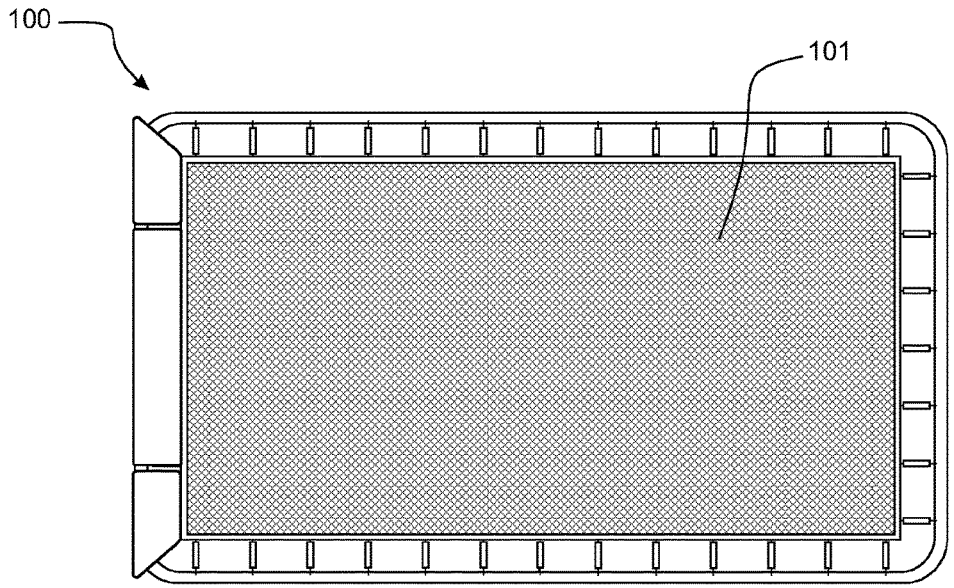
FIG. 17*b* is a plan view of the trampoline of FIG. 17*a;*
Figure 18A:
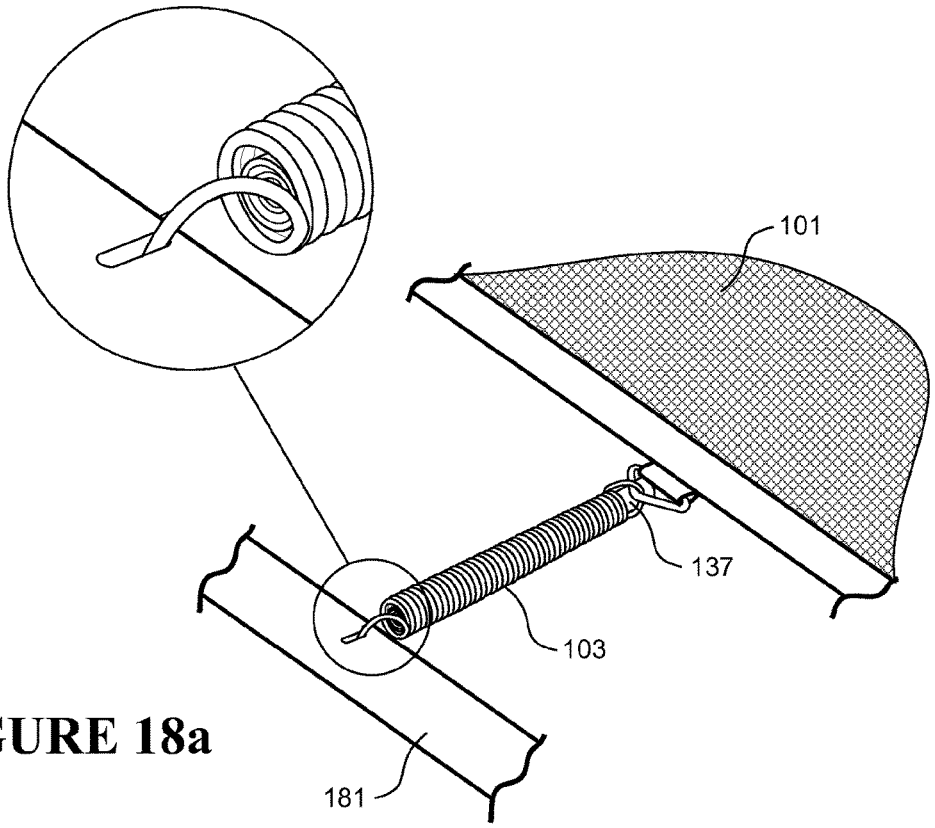
FIG. 18*a* is a detail view of a coupling for a wiring loom of the trampoline of FIGS. 17*a* and 17*b;*
Figure 18B:
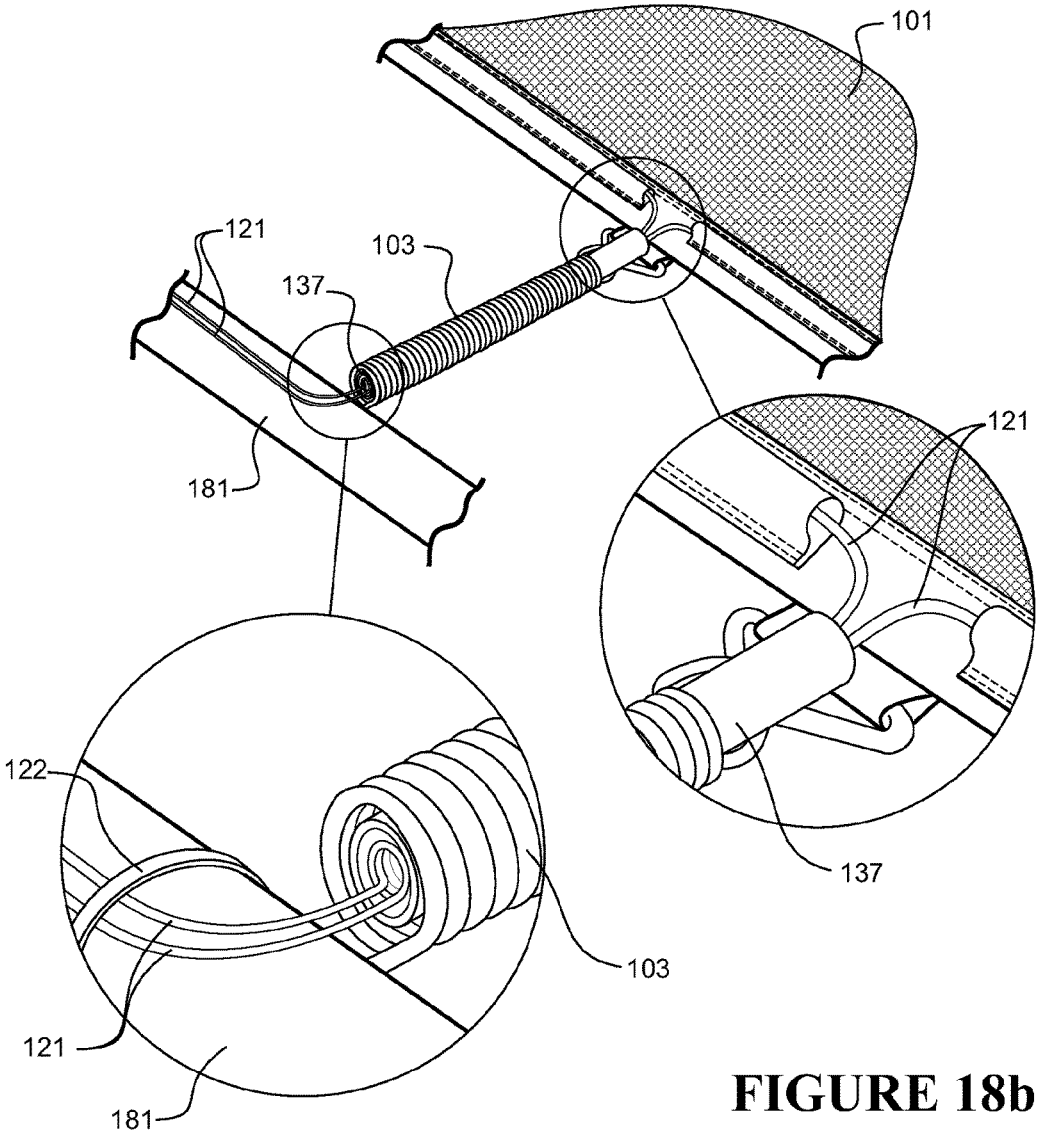
FIG. 18*b* is a perspective view from underneath of the coupling of FIG. 18*a;*
Figure 18C:
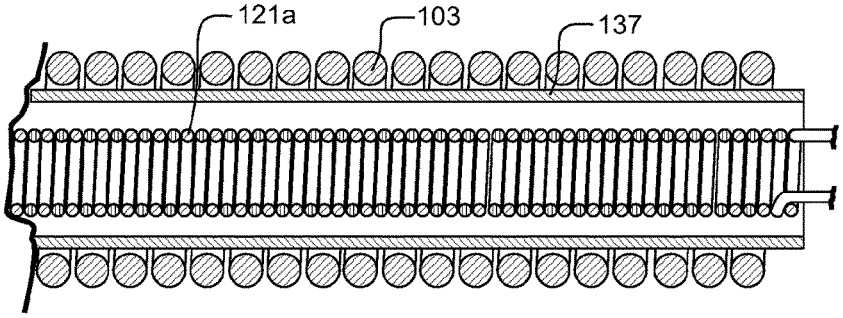
FIG. 18*c* is a cross-sectional view of the coupling of FIG. 18*a;*

With reference to FIGS. 17*a*, 17*b*, 18*a*, 18*b*, and 18*c*, an alternative embodiment trampoline 100 is shown. This trampoline has a frame 181, typically a steel frame, around the mat, and a plurality of coil springs 103 coupled between the frame and the mat 101 about a periphery of the mat suspend the mat in the frame. Each spring 103 has a first end 103*a* attached to the mat and a second end 103*b* attached to the frame. Unless described as otherwise below, the system such as sensor mounting to the mat, can be the same as already described above, and like reference numerals indicate like parts with the addition of 100. In this embodiment, tubular coupling 137 extends outwardly from the periphery of the mat 101. The coupling 137 may extend within one of the coil springs 103. In turn a portion, which may comprise a wire coil as shown, of the wiring loom to the sensors mounted on the underside of the mat, extends through the tubular coupling 137, as shown in FIGS. 18*a* to 18*c*. The tube houses the coiled wiring loom and prevents the wiring loom being caught between the coils of the coil spring. The portion of the wiring loom comprises a plurality of coils. The coils allow the wiring loom to extend and contract when required, for example, when the coil spring of the trampoline extends and contracts as a user or object bounces on the mat. The wiring looms exit the tube at the frame end together and are attached to the frame 181, for example by a cable tie 122. The wiring looms extend along the frame to the controller 179, as shown in FIG. 17*a*. The wiring looms exit the mat end of the tube, where they separate and then travel in generally opposite directions around the periphery of the mat 101. In this embodiment, the wiring loom(s) extend(s) around the periphery of the mat. When viewed from above, the wiring loom(s) have a substantially square or rectangular shape with rounded corners.

The foregoing describes the invention including preferred forms thereof. Modifications and improvements as would be obvious to those skilled in the art are intended to be incorporated in the scope hereof, as defined by the accompanying claims.

The invention claimed is:

1. A trampoline comprising:

multiple movement sensors associated with one or more parts of the trampoline which move when the trampoline is bounced on by a user, which sensors provide an electrical signal indicative of bouncing on the trampoline;

a controller or a connector at a controller/connector end of the wiring loom; and an electrical wiring loom which connects to the multiple movement sensors at one or more sensor ends of the wiring loom or comprises multiple sensor connectors which connect to the multiple movement sensors, and which electrical wiring loom extends from the multiple movement sensors or sensor connectors to the controller or connector, wherein said multiple movement sensors are associated with a mat of the trampoline and are attached to the mat each by a mount comprising a topside mount part on one side of the trampoline mat and an underside mount part on another side of the trampoline mat, which topside mount part and underside mount part are fixed together through the trampoline mat.

2. A trampoline according to claim 1 wherein said topside mount part and underside mount part are fixed together through the trampoline mat by at least one projection from one of said topside mount part and underside mount part which is snap fit received in the other of said topside mount part and underside mount part.

3. A trampoline according to claim 2 wherein the wiring loom comprises a first wiring loom branch to two or more movement sensors or sensor connectors and a second wiring loom branch to two or more other movement sensors or sensor connectors.

4. A trampoline according to claim 3 wherein said first wiring loom branch is routed at or near one peripheral part of the mat and said second wiring loom branch is routed at or near another peripheral part of the mat.

5. A trampoline according to claim 4 wherein the wiring loom comprises four or more wiring loom branches routed at or near a periphery of the mat to four movement sensors or sensor connectors.

6. A trampoline according to claim 2 wherein said projection comprises a pointed end adapted to pierce the mat of the trampoline.

7. A trampoline according to claim 1 wherein at least a part of the wiring loom is routed at least in part in a pocket at or near a periphery of the mat.

8. A trampoline according to claim 1 wherein at least a part of the wiring loom is routed from at or near a periphery of the mat along a spring element of the trampoline to or towards a frame of the trampoline.

9. A trampoline according to claim 1 wherein the wiring loom extends at said another end of the wiring loom to a controller enclosure attached to a frame of the trampoline.

10. A trampoline according to claim 1 also comprising a display mount for mounting to the trampoline a display driven by the controller and wherein the display mount is adapted to mount the display to an enclosure above and around the mat of the trampoline.

11. A trampoline electrical wiring loom system comprising:

a wiring loom multiple movement sensors attached and electrically connected to the wiring loom, to provide an electrical signal indicative of bouncing on the trampoline when attached to a part or parts of the trampoline which move when the trampoline is bounced on by a user;

mounts for attaching the multiple movement sensors to a mat of the trampoline, each mount comprising a topside mount part and an underside mount part adapted to be fixed together through the trampoline mat to mount the movement sensor to the trampoline mat; and a controller or a common connector at an end of the wiring loom.

12. A trampoline electrical wiring loom system according to claim 11 wherein said topside mount part and underside mount part are adapted to be fixed together through the trampoline mat by at least one projection from one of said topside mount part and underside mount part which is snap fit received in the other of said topside mount part and underside mount part.

13. A trampoline electrical wiring loom system according to claim 11 together with a trampoline mat comprising multiple movement sensors or multiple movement sensor mounts attached at spaced locations to the mat.

* * * * *